US012420162B2

(12) United States Patent
Leon et al.

(10) Patent No.: US 12,420,162 B2
(45) Date of Patent: Sep. 23, 2025

(54) GOLF BALL RETURN SYSTEM AND METHOD

(71) Applicants: Victor Leon, Lomita, CA (US); Ian Osborne, Gardena, CA (US); George Foster, Placerville, CA (US)

(72) Inventors: Victor Leon, Lomita, CA (US); Ian Osborne, Gardena, CA (US); George Foster, Placerville, CA (US)

( * ) Notice: Subject to any disclaimer, the term of this patent is extended or adjusted under 35 U.S.C. 154(b) by 20 days.

(21) Appl. No.: 18/486,132

(22) Filed: Oct. 12, 2023

(65) Prior Publication Data

US 2024/0123316 A1 Apr. 18, 2024

Related U.S. Application Data

(60) Provisional application No. 63/415,439, filed on Oct. 12, 2022.

(51) Int. Cl.
*A63B 69/40* (2006.01)
*A63B 24/00* (2006.01)
(Continued)

(52) U.S. Cl.
CPC ..... *A63B 69/406* (2013.01); *A63B 24/0062* (2013.01); *A63B 47/025* (2013.01);
(Continued)

(58) Field of Classification Search
CPC ..... A63B 47/025; A63B 2063/001; A63B 71/022
(Continued)

(56) References Cited

U.S. PATENT DOCUMENTS 3,037,776 A * 6/1962 Younce ..... A63B 63/00 124/53.5
3,260,527 A * 7/1966 Younce ..... A63B 63/00 473/166
(Continued)

FOREIGN PATENT DOCUMENTS

CA 2032906 A1 6/1992
CA 2509364 A1 12/2006
(Continued)

OTHER PUBLICATIONS

English machine translation of KR-101394267-B1 (Shin) (Year: 2014).*
(Continued)

*Primary Examiner* — Jeffrey S Vanderveen
(74) *Attorney, Agent, or Firm* — Scott R. Hansen; Viking IP Law

(57) ABSTRACT

Embodiments of the present disclosure may include a system for returning a golf ball to a golfer playing simulated golf or hitting a golf ball towards any vertical surface or hitting it into a net or such, the system including a ball catcher tray assembly adapted to receive a golf ball after the golfer has hit the ball against an impact surface, the ball catcher tray optionally including ball catcher tray sections connected together. Embodiments may also include a golf ball launcher adapted to receive the golf ball as it rolls from the ball catcher tray assembly. Embodiments may also include a modular track system comprised of interconnected track sections, at least one of which may be connected to the golf ball launcher and may be adapted to receive the golf ball from the golf ball launcher as the ball may be propelled toward the golfer.

20 Claims, 20 Drawing Sheets

(51) Int. Cl.
*A63B 47/02* (2006.01)
*A63B 63/00* (2006.01)
*A63B 102/32* (2015.01)

(52) U.S. Cl.
CPC ..... *A63B 2063/001* (2013.01); *A63B 63/007* (2013.01); *A63B 2102/32* (2015.10)

(58) Field of Classification Search
USPC ..... 473/163, 182–184, 191
See application file for complete search history.

(56) References Cited

U.S. PATENT DOCUMENTS

| | | | | |
|---|---|---|---|---|
| 3,567,223 | A * | 3/1971 | Gentiluomo | A63B 69/3694 473/166 |
| 4,177,994 | A * | 12/1979 | Lindquist | A63B 24/0021 473/156 |
| 4,215,865 | A | 8/1980 | Pilati | |
| 4,634,130 | A | 1/1987 | Simjian | |
| 4,783,075 | A | 11/1988 | Simjian | |
| 4,828,267 | A | 5/1989 | Goodrich | |
| 5,042,813 | A | 8/1991 | Huang | |
| 5,102,141 | A | 4/1992 | Jordan | |
| 5,123,651 | A | 6/1992 | Vinciguerra | |
| 5,129,653 | A | 7/1992 | Morris | |
| 5,141,226 | A | 8/1992 | Cavanagh | |
| 5,165,690 | A | 11/1992 | Kelley, Jr. | |
| 5,306,009 | A | 4/1994 | Bolanos | |
| 5,441,266 | A | 8/1995 | Cedrone | |
| 5,690,555 | A | 11/1997 | Lay | |
| 6,398,661 | B1 | 6/2002 | Llewellyn | |
| 6,398,662 | B1 | 6/2002 | Cox | |
| 6,497,625 | B2 * | 12/2002 | Newby | A63B 47/025 473/166 |
| 6,572,485 | B2 | 6/2003 | Howard | |
| 6,595,863 | B2 | 7/2003 | Chamberlain | |
| 6,623,371 | B2 | 9/2003 | Corcoran | |
| 7,066,845 | B2 * | 6/2006 | Joseph | A63B 69/0071 124/78 |
| 7,137,910 | B2 * | 11/2006 | Ktson | A63B 69/406 124/79 |
| 7,318,777 | B1 | 1/2008 | Sells | |
| 7,563,171 | B2 | 7/2009 | Barz | |
| 7,645,197 | B2 | 1/2010 | Hicks | |
| 2004/0137994 | A1 | 7/2004 | Chang | |
| 2008/0234061 | A1 | 9/2008 | Luna | |
| 2018/0147462 | A1 * | 5/2018 | Arnold | A63B 63/00 |
| 2023/0020996 | A1 | 1/2023 | Jones | |
| 2023/0041683 | A1 | 2/2023 | Paton | |
| 2023/0310961 | A1 | 10/2023 | Marvin | |

FOREIGN PATENT DOCUMENTS

| | | | |
|---|---|---|---|
| CN | 213555286 U | * | 6/2021 |
| CN | 216986249 | | 7/2022 |
| GB | 2129310 A | | 5/1984 |
| KR | 101394267 B1 | * | 5/2014 |
| WO | 1998031435 A1 | | 7/1998 |

OTHER PUBLICATIONS

English machine translation of CN-213555286-U (Wang) (Year: 2021).*

* cited by examiner

GOLF BALL RETURN SYSTEM AND METHOD

RELATED APPLICATIONS

This patent application claims the benefit under 35 USC 119 of U.S. Provisional Patent Application Ser. No. 63/415,439, entitled "GOLF BALL RETRIEVAL AND RETURN SYSTEM" filed Oct. 12, 2022, the contents of which are incorporated herein by reference in their entirety.

BACKGROUND

In simulated golf play, systems have been developed to return a golf ball to a golfer after it has been hit towards a projection surface. These systems typically involve a projection surface to stop the forward movement of the golf ball, for example. Once the golf ball is stopped by the screen, it needs to be retrieved and returned to the golfer for the next shot.

One approach in the prior art involves manual retrieval of the golf ball, which can be time-consuming and disrupting to the flow of the game.

Golf Simulator Systems are a popular and significant addition to indoor golf play. Golf simulator systems range from commercial venues to home systems, and can range from hundreds to many thousands of dollars.

Typically, golf simulator systems allow golfers to hit golf balls toward an electronically displayed active image of a golf course presented on a large screen typically via front projection. Alternatively, a golfer can hit a golf ball towards a passive golf course graphic printed on a screen, or even a non-graphical impact-resistant surface.

Embodiments of the invention described herein improve the overall play experience of golf simulator systems by eliminating the distraction of having to walk around to retrieve golf balls already hit. Retrieving golf balls interrupts the golfer's concentration, forces them off their position on the hitting mat, interfere with their swinging repetitions and such. This can throw off the timing, rhythm, concentration and posture of the player, during golf play practice.

Embodiments of the invention address these inconveniences and can be adapted to accommodate a variety of different third party golf simulator systems.

BRIEF SUMMARY

Embodiments of the present disclosure may include a system for returning a golf ball to a golfer who may be playing simulated golf, the system including a modular ball catcher tray assembly adapted to receive a golf ball after the golfer has hit the ball against an impact surface, the modular ball catcher tray including ball catcher tray sections connected together.

Embodiments may also include a golf ball launcher adapted to receive the golf ball as it rolls from the modular ball catcher tray assembly. Embodiments may also include a modular track system comprised of interconnected track sections, at least one of which may be connected to the golf ball launcher and may be adapted to receive the golf ball from the golf ball launcher as the ball may be propelled toward the golfer.

Embodiments may also include a ball holding tray at one end of the modular track system, the ball holding tray being located adjacent to an area from which the golf player hits the ball. Embodiments may also include a ball braking device adjacent to the ball holding tray for slowing the ball as the ball approaches the ball holding tray. Embodiments may also include a control panel adapted to permit the golfer to control an aspect of the system for returning the golf ball.

In some embodiments, the ball catcher tray sections may include foam material. Embodiments may also include each of the ball catcher tray sections have a trough on which a ball can roll. In some embodiments, the ball catcher tray sections wedge shaped ramp sections secured within the respective troughs, such that the wedge shaped ramp sections in sequence form a downwardly-sloping path for a ball to roll down.

The ball catcher tray sections may optionally each have an angled top surface to direct a ball to roll toward a respective trough. In some embodiments, the ball catcher tray sections may be secured together with connector pins on the underside of the ball catcher tray sections. In some embodiments, the track sections may include straight track sections and curved track sections.

In some embodiments, the system includes a plurality of shingles at a top edge of the ball catcher tray assembly. In some embodiments, the shingles may be movable. In some embodiments, the ball launcher may be at an end of the ball catcher tray assembly, with the ball catcher tray assembly sloping downwardly toward the ball launcher The ball launcher may optionally be in between ends of the ball catcher tray assembly, with the ball catcher tray assembly having a top surface configured to cause a ball to roll toward the ball launcher. In some embodiments, the control unit may be located adjacent to a location where the golfer golfs. In some embodiments, the system may include a stand for holding smart devices such as, for example a smartphone or digital tablet.

Embodiments may also include a smartphone or tablet computer that controls at least one function of the system. In some embodiments, the track sections connect in a desired sequence with track connectors. In some embodiments, the track sections may include space underneath said track section to accommodate wiring. In some embodiments, the impact surface may be an impact-absorbing screen onto which a golf image or video may be projected, while in others it may be a different type of surface such as a net or other surface.

Embodiments of the present disclosure may also include a golf ball return system for returning a golf ball to a golfer, the system having a connector that movably couples the golf ball return system to an impact absorbing surface adapted to received golf balls that the golfer hits. Embodiments may also include a ball catcher tray comprised of down-angled foam sections to direct a golf ball to roll towards a ball launcher assembly.

The ball launcher assembly may have a down-angled pathway and a ball sensor to detect the presence of the golf ball and activate a ball driver to propel the ball. Embodiments may also include a track coupled to an exit end of the ball launcher to receive the golf ball and to direct the ball towards the golfer. Embodiments may also include a speed brake to slow momentum of the ball.

Embodiments may also include a holding tray adjacent to the golfer and into which the golf ball may be deposited to the golfer. Embodiments may also include a golfer-controlled speed control allowing the golfer to adjust speed of ball return. In some embodiments, the ball return system may include at least one movable shingle coupled to the impact absorbing surface.

Embodiments of the present disclosure may also include a method of returning a golf ball to a golfer in simulated golf play, in a simulated golfing system having an impact-absorbing screen for receiving golf balls that the golfer hits at said screen, a modular golf ball return system having a plurality of sections that when connected together form a ball catching tray below the impact-absorbing surface, a ball propelling device, and a modular conduit leading from the ball-propelling device to the golfer, the conduit including a plurality of conduit sections which when connected together form the conduit, the method including the steps of hitting a golf ball toward the impact-absorbing screen.

Embodiments may also include stopping forward movement of the golf ball with the impact-absorbing screen. Embodiments may also include receiving the golf ball from the impact-absorbing screen as gravity pulls the ball down into the ball catching tray. Embodiments may also include receiving the ball as it rolls from the ball catching tray into a ball-propelling device. Embodiments may also include propelling the golf ball with the ball-propelling device through the conduit toward the golfer. Embodiments may also include depositing the golf ball in an area adjacent to the golfer.

The system may have a speed control to vary the speed of ball return, the method further including adjusting the speed of ball return with the speed control. In some embodiments, the method may include a step of collecting data concerning performance of the golfer. In some embodiments, the method may include analyzing the data with an artificial intelligence system adapted to interact with a golfer.

In some embodiments, the method may include assembling the ball-catching tray adjacent to the net or screen. In some embodiments, the golf ball return system further has shingles coupled to the trough or tray. In some embodiments, the ball-propelling device has an exit end from which a propelled golf ball exits, and the conduit may include sections, at least one of the sections of the conduit coupled to the ball-propelling device.

In some embodiments, the sections of the conduit may include straight sections and curved sections. In some embodiments, the sections may be connected in a chosen sequence. In some embodiments, the method may include connecting at least one section to another section with a connector. In some embodiments, the ball return system includes a ball brake, and the method may include slowing ball speed with the ball brake. In some embodiments, the ball return system includes at least one control panel having an electronic controller, a display screen, a sound system, and control knobs.

Embodiments of the present disclosure may also include a method of returning a ball to a player in a simulated sports game system having a target surface onto which a player hits the ball, and a ball return system having a modular ball catching tray below the target surface, a ball-propelling device, a conduit leading from the ball-propelling device to the golfer, the method including the steps of hitting a ball onto the target surface. Embodiments may also include receiving the ball from the target surface into the modular ball catching tray. Embodiments may also include propelling the ball with the ball-propelling device through the conduit toward the player. Embodiments may also include depositing the ball in an area adjacent to the golfer.

In some embodiments, the system includes a speed control to vary a speed of ball return, the method further including adjusting the speed of ball return with the speed control. In some embodiments, the method may include a step of collecting data concerning performance of the player. In some embodiments, the method may include analyzing the data with an artificial intelligence system.

In some embodiments, the method may include assembling the modular ball catcher tray assembly from foam catcher tray sections, and adjacent to the target surface. In some embodiments, the golf ball return system further has shingles coupled to the tray. In some embodiments, the ball-propelling device has an exit end from which a propelled ball exits, and the conduit may include sections, at least one of the sections of the conduit coupled to the ball-propelling device.

In some embodiments, the sections of the conduit may include straight sections and curved sections. In some embodiments, the sections may be connected in a chosen sequence. In some embodiments, the method may include connecting at least one track section to another track section with a connector.

In some embodiments, the ball return system includes a ball brake, and the method may include slowing ball speed with the ball brake before the ball reaches the player. In some embodiments, the ball return system includes at least one control panel having an electronic controller, a display screen, a sound system, and control knobs.

It should be understood that the invention is not limited to a specific combination of optional features. Consequently, the foregoing lists various optional features that may be combined in different ways than those specifically identified as examples.

OVERVIEW OF PREFERRED EMBODIMENTS

Figure 1:
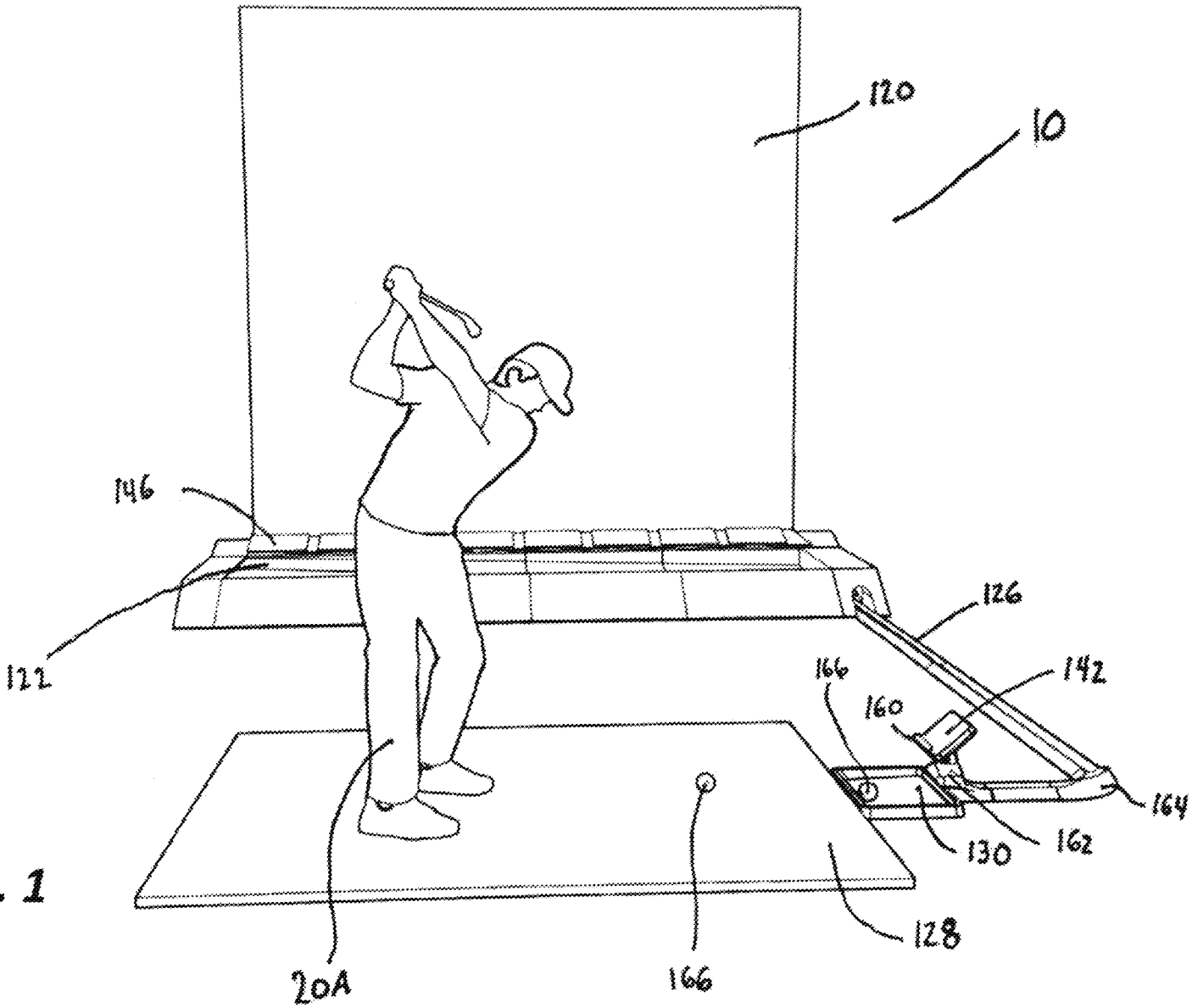
FIG. 1 illustrates an embodiment according to the present invention in which a golfer hits a golf ball toward a screen.

One embodiment of the invention is comprised of a ball catcher tray assembly 122, a ball launcher 124 to launch the ball from the ball catcher into or onto a track assembly 126, and deliver the ball back to the area where the golfer 20 took his or her last shot, with the ball stopping preferably in a small ball holding tray 130 or directly onto a teeing mat 128 or floor, from which the golfer 20 can then easily move the ball by hand or by club movement, into position for the player's next shot.

In some embodiments, the golfer 20 may remain in generally the same location from which he made his last shot, thereby allowing the golfer 20 to improve or duplicate his prior-shot performance.

The ball catcher tray 122 sections, into which the ball would drop after striking the screen of a golf simulator system, may be constructed of several similar or identical sections of material, preferably custom-formed foam, although the pieces could be constructed from other materials, such as plywood, polymers, a composite, or other material that can absorb the impact of the traveling ball without resulting in the ball bouncing away from the ball catcher assembly. Said custom-formed foam can be comprised of expanded polypropylene foam, or a polyurethane foam, or similar durable foams.

Custom formed-foam or similar material is a presently-preferred material for the ball catcher tray 122 sections, which may be designed to be easily assembled end to end, and connected one to another by clips or pins or pegs into holes or via similar joining methods, or they could be taped together or attached to the floor of the area in which the invention is to be utilized. Alternatively, instead of foam sections, a ball catching means could be comprised of netting or fabric held in place by a frame structure. The overall width of the assembled ball catcher may be configured to be approximately the width of the third-party golf simulator screen that the golfer 20 was utilizing. For example, an 8-foot wide screen may have generally an 8-foot wide ball catcher aligned with the screen, sitting in front of the screen, on the floor.

An alternative embodiment utilizes a large net attached to the bottom of the Simulator screen, or separate from said screen and located in between the golfer 20 and the screen.

In the preferred embodiment, the utilization of molded foam sections with a ball catcher tray 122 has desirable performance, can be easy to assemble properly, and may be durable and consistent in delivering a golf ball to the ball launcher 124.

In one non-limiting example, foam sections of the invention's ball catcher tray 122 may be comprised of 4 two-foot modules positioned and then connected together by the user of the invention. The ball catcher sections would not be flat, but instead sloped downward towards a centerline in said sections so that the ball traveling onto the attached sections would travel, by virtue of gravity, downward towards a longitudinal drop-down slot where the ball could then fall into a track section 152 to direct the ball towards a motorized ball launcher 124 that would then launch the ball into a tunnel and/or track system to eventually direct the ball back to a position near the golfer 20, who can then take his or her next shot.

In another non-limiting example, foam sections of the invention's ball catcher tray 122 may be comprised of 4 identical two-foot modules positioned and then connected together by the user of the invention. The ball catcher sections would not be flat, but instead sloped downward towards a centerline in said sections so that the ball traveling onto the attached sections would travel, by virtue of gravity, downward towards a longitudinally-located drop-down slot where the ball could then fall onto wedge-shaped ramp sections to direct the ball towards a motorized ball launcher 124 that would then launch the ball into a tunnel and/or track system to eventually direct the ball back to a position near the golfer 20, who can then take his or her next shot.

At the ends of the sections of the ball catcher, end-cap pieces may be installed to keep the moving ball from falling off the sides of the constructed trough.

In one embodiment of a ball launcher 124, a motorized drive wheel section and its components may be powered by an electric motor 140, for example a (small) Mabuchi RS-380PH motor 140 or by a more robust motor, for example Rs-550SF-6035 by Electronics Express, China that operated either on batteries (such as several "D" cell batteries) or the ball launcher could be powered by a similar motor that receives power from a small step-down transformer utilizing 110 AC house current and then converts to 12 volt DC current. It should be noted that less than 12-volts DC current can be utilized to operate the motor 140.

Once the ball has travelled downward into the slot or hole in the ball catcher and then into a small tube or tunnel, the ball would continue, by its own momentum and assisted by gravity, to activate a motor 140 by means of the ball engaging a micro-switch or breaking an infrared light beam to activate a switch to engage power to a motor 140 that would cause a friction wheel or wheels (preferably covered with rubber or other gripping material) to spin and grab and thrust the ball forward and then out into a track or tunnel travel pathway, described further below, that will send the ball back to the golfer 20, who can then take his or her next shot.

As one alternative to a motorized ball launcher 124, the trough sections could be dimensioned to catch the ball dropping off the Simulator screen at sufficient height from the ground plane to provide momentum to activate the ball rolling towards the golfer 20. Additional slight downward slope of track sections 152 assist the gravity induced rolling action of the ball. As a further alternative, other systems may be used to propel the ball toward the golfer 20, such as pneumatic propulsion and/or other systems.

In one embodiment, a control unit 142 and holding tray 130 section of the invention, housing electronics, would preferably be located close to where the golfer 20 would stand while taking swings at the golf ball. Alternatively the control unit 142 could be remote from the golfer 20 and could receive a wireless signal or signals from the golfer 20, by way of infrared or Bluetooth or similar wireless protocols from either a small dedicated sender unit (sold as part of the system of the invention and) held by the golfer 20, or the golfer 20's smartphone, by way of an app for example.

The control unit 142 could also accommodate the placement of a smartphone or tablet so the user could access controls, and features of an app coordinated to the invention as well as post or share his gameplay with other online players. It should be noted that golf simulator systems often come with apps for smart devices.

In a presently-preferred embodiment, the golfer 20 manually operates a control unit 142 located near the golfer 20, with the buttons of the control unit 142 able to be activated and selected by the golfer 20 using his golf club for such operation, or by pressing buttons on the control unit 142 with his fingers. Either method of control will still allow the golfer 20 to at very least keep their feet in the relatively same position as he was located during his prior shot.

One goal of this invention is to provide the golfer 20 with the least amount of distraction or inconvenience, to maintain their pose, posture and mental and physical composure between shots, not interrupted by distractions.

The control unit 142 can have a master power on-off button (or switch), speed adjustment controls to assure the ball travels at the correct speed to arrive at the holding tray 130, an "override" switch that can be activated in the event a ball in the system fails to trigger the motor 140 activation circuit.

Concerning the optional override switch, it may be in the control unit 142, for example. In the event a golfer 20 does not have any master power turned on, whether or not a ball might roll past an infrared sensor or come into contact with a micro-switch, no power would activate the motor 140 to spin the drive wheels intended to thrust the ball forward into the track or tunnels of the system. Instead, when a ball is played into a system that is "off power," the golf ball would hit the display screen, drop down and roll up to and against the drive wheels, but would fail to activate any power turning on to activate said drive wheels. The ball would therefore by stuck up against the drive wheels. The golfer 20, activating the over-ride switch or button, would turn on the motor 140 to full power to spin and grab the ball and thrust it through the drive wheels assembly and then launch the ball to the golfer 20. The over-ride button and feature could then either leave the system in its ON and operative mode, or could simply operate that one time and then await a master "power on" command by another button on the control unit 142. The control unit 142 could also contain a printed integrated circuit to provide sounds and lights activation to signal "unit on" and which of any special functions might be selected the golfer 20—speed, time on, auto-on, crowd cheering noises, etc.

It is understood that preferred embodiments can work independently from of, or in combination with, existing golf simulators. Without a golf simulator, the golfer 20 could simply hit a golf ball into a net or screen, and the ball could be automatically returned to the golfer 20, as described above, for example.

Considering an approach according to the present invention, in one embodiment the golfer 20 places their ball in the designated hitting area, usually a teeing mat 128. Once the ball is placed where desired, the golfer 20 swings his club to strike and launch the ball. Golf simulator systems typically understood by anyone skilled in the art function by analyzing data produced from the golf shot, recorded by a camera included in or coupled to the golf simulation system, sometimes including a camera in a golfer 20's smartphone that can be running an app associated with the third-party golf simulation system. Data such as ball speed, spin, launch angle, etc. can be analyzed as well as displayed on digital screens associated with the third party app, and also data can be remotely projected onto the Simulator screen.

Some of the most common technologies to measure this data include (as non-limiting examples only) Radar, one or more cameras (which may include smartphone cameras), optical sensors, and sensor mats, for example, although other types of sensors may be used.

Once data has been collected the simulator will simulate the characteristics of the golfer 20's shot on a screen, projecting an appropriate image coordinating to the determined characteristics of that particular shot.

Embodiments described herein may be adapted to work with various simulated golf systems, and with launch monitors, golf practice systems, and/or simple ball-catching nets or screens. Although examples presented herein primarily focus on golf, embodiments of the present invention may optionally include systems for playing or practicing simulated tennis, baseball, basketball, and other sports or games in which a ball is directed toward a surface then is returned to the player.

DETAILED DESCRIPTION OF A PREFERRED EMBODIMENT

Embodiments of the present invention may include, as examples only and in various combinations:

- Ball catcher tray assembly, which in one embodiment has 4 sections each approximately 2'×2', for example, although many dimensions are possible. The sections are modular and can be assembled to differing widths by assembling more or fewer sections, as desired;
- Ball launcher, which may include electro-mechanical components such as a motor, or other mechanism to propel a ball down a conduit leading to the user;
- Track assembly, which may optionally be assembled from modular sections attached together;
- Ball Holding Tray; and
- Control unit Embodiments may include other components, such as a teeing mat, a simulator screen, a projector, balls, and such, which may be optionally be provided by a third party supplier.

Referring now to the drawings, FIG. 1 illustrates an embodiment of a ball return system 10 according to the present invention in which a golfer 20 hits a golf ball toward a screen 120. In figure one, a right-handed golfer 20 stands on a teeing mat 128. A ball rests on the teeing mat 128 and the golfer 20 will strike the ball such that it flies toward a third party simulator screen 120. The screen 120 is typically made of an impact absorbing material such that when the ball strikes the simulator screen 120 its motion is stopped and gravity pulls it down into the ball catcher tray assembly 130. Shingles 146 may be located toward the bottom of the simulator screen to help guide the balls into the ball catcher tray assembly 130.

Regarding the shingles, when the ball hits the screen, the ball's impact will move the screen backward somewhat. That movement serves as a shock absorber, it results in reduction of ball speed and the ball will not be as inclined to rebound as far. Because the shingles are coupled (by attachment) to the screen and only resting atop the ball catcher assembly (not fixably attached), the shingles also can move/slide backwards and still prevent a gap from opening up between the screen and the ball catcher. Such a gap would be problematic were it to occur. The sliding action of the shingles prevent that.

Golf balls 166 are returned to the golfer 20 along a track assembly 126 or conduit and are returned to a ball holding tray 130. The track assembly 126 may include straight sections 168 and or curved track sections 164 assembled so as to reach the teeing mat 128 in whatever configuration is most suited for the particular geometry of the location of the mat 128 relative to the simulator screen 120. Near the ball holding tray 130, there may be a ball braking mechanism 162 such as a ball braking tunnel with a ball deflector 188 to slow the ball as it approaches the ball holding tray 130 so that it may be held within the ball holding tray 130 without rolling out.

The system may also include a phone or tablet lip on which to accommodate a phone or tablet computer. This may be part of a control unit 142 and display which allows the golfer 20 to control such aspects as the speed of the ball traveling along the track assembly 126, what is shown on the simulator screen, and various other controls. The control unit 142 and display may either have electronics of its own use to control the ball collecting and return system and or other aspects of the simulated golf system. As an alternative, the control unit 142 and display may simply can have a stand for a smartphone or tablet or other portable device that controls the system through an app, such as by internet or Bluetooth connection to components of the simulated golf system.

Although many variations are possible, in some embodiments the teeing mat and simulator screen are provided by a third party and the ball catcher and return system is assembled at and provided to the pre-existing simulated golf system so as to provide a convenient ball return mechanism to any of a variety of pre-existing golf simulation systems.

Figure 2B:
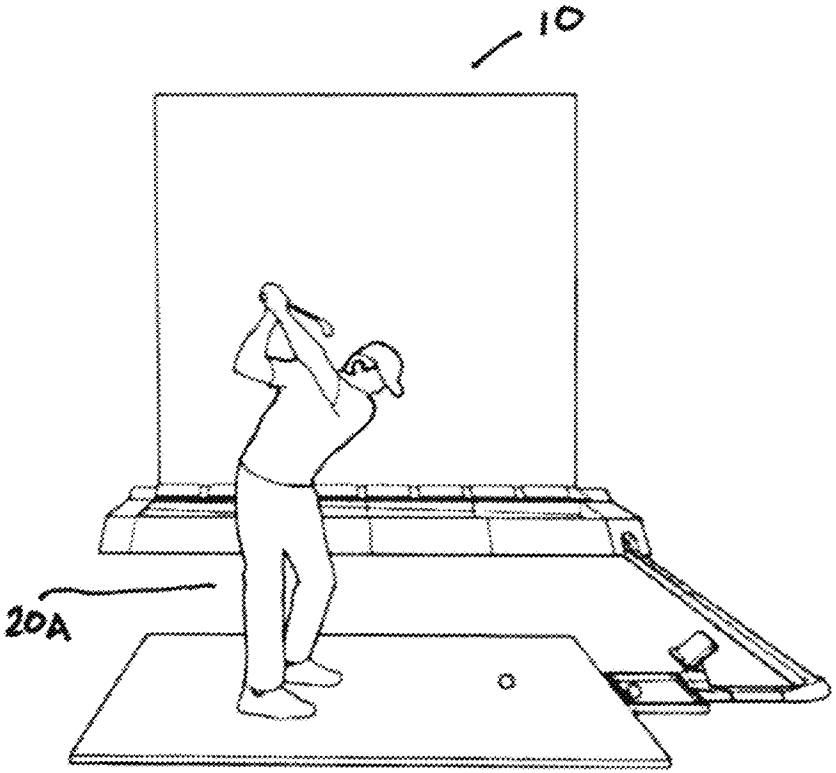
FIGS. 2A and 2B illustrate both left and right-handed versions of an embodiment of the present invention.
Figure 2A:
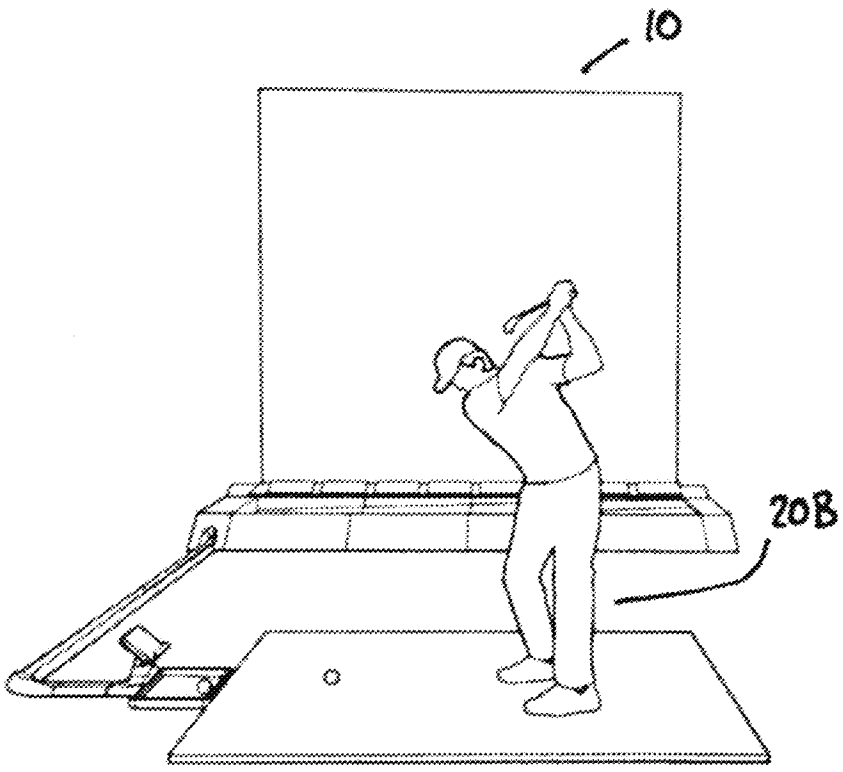

FIGS. 2A and 2B illustrate both left and right-handed versions of an embodiment of the present invention. As can be seen in FIGS. 2A and 2B, in one preferred embodiment the system may be configurable two different geometries of the golf simulator. As just one example the golfer 20 may be left-handed 20B or right-handed 20A and, either way, the return track and ball catcher tray assembly 130 may be configured to return the ball to a point as desired. It should be noted that in some configurations (for example FIG. 13), the user may wish the tray 130 to be in front of the mat 128 or behind the mat or elsewhere. Consequently, being able to configure the return system as desired can be an advantage in some embodiments.

Figure 3:
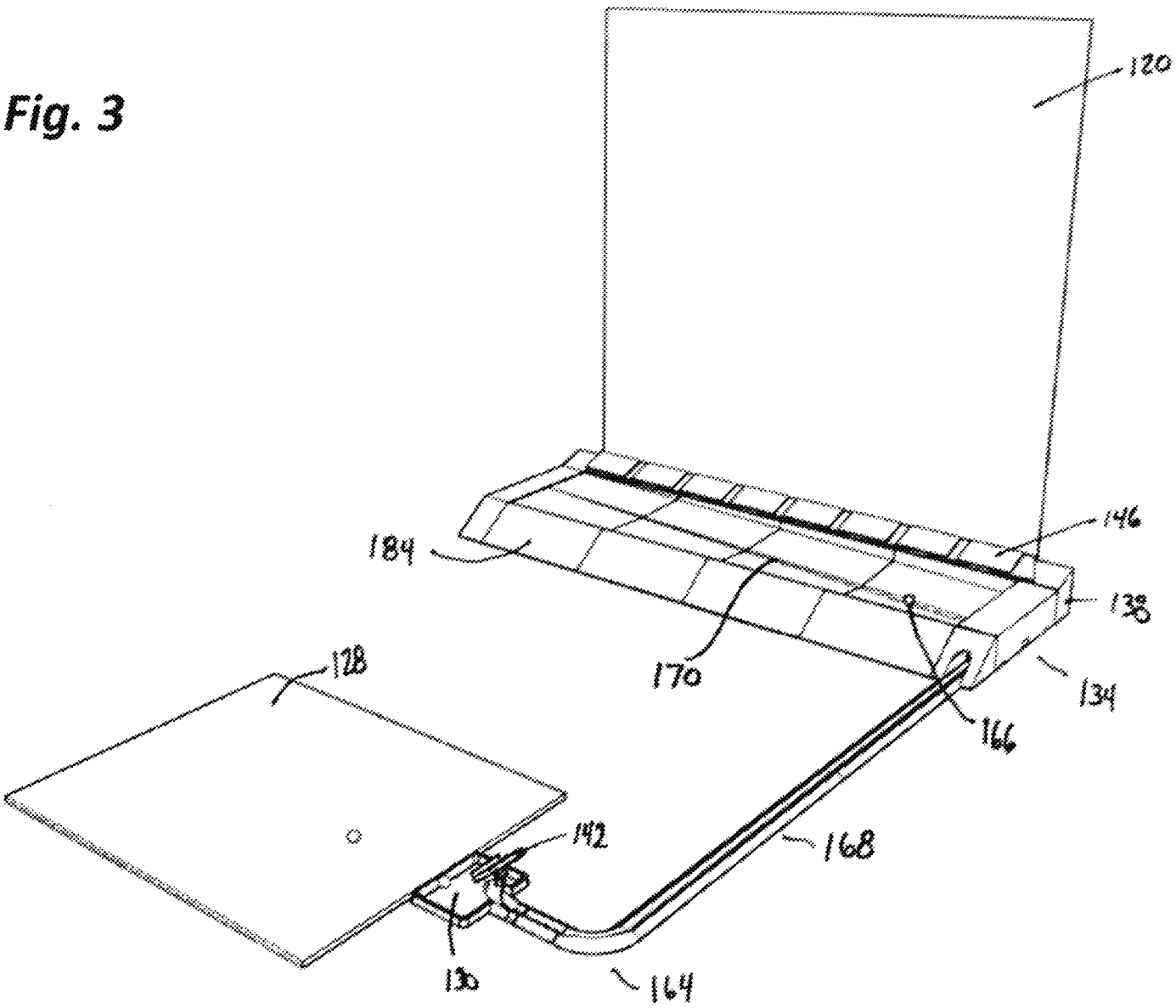
FIG. 3 illustrates an embodiment having a screen, a ball catcher tray, and a conduit or track leading back to a mat from which a golfer hits the ball.

FIG. 3 illustrates an embodiment having a screen 120, a ball catcher tray 122, and a conduit or track 126 leading back to a mat from which a golfer 20 hits the ball. FIG. 3 illustrates another view of the ball return system. As seen in FIG. 3, the ball catcher tray assembly 130 may have a top surface that declines toward one end of the ball catcher tray assembly 130. At the end of the ball catcher tray assembly 130 to which the ball rolls, there is a ball launcher 124. The ball launcher 124 receives the ball from the ball catcher tray assembly 130 top surface then propels the ball along the track and to holding tray 130. The ball rolls down the ball catcher tray assembly 130 along a trough 196 within the ball catcher tray assembly 130 such that the trough 196 guides the ball into an entrance to the ball launcher 124. As will be discussed, the ball launcher 124 may include a motor 140 to propel the ball along the track toward the user, or there may be other types of ball propelling devices, such as for example pneumatic devices or other devices known in the art for propelling balls.

Figure 4:
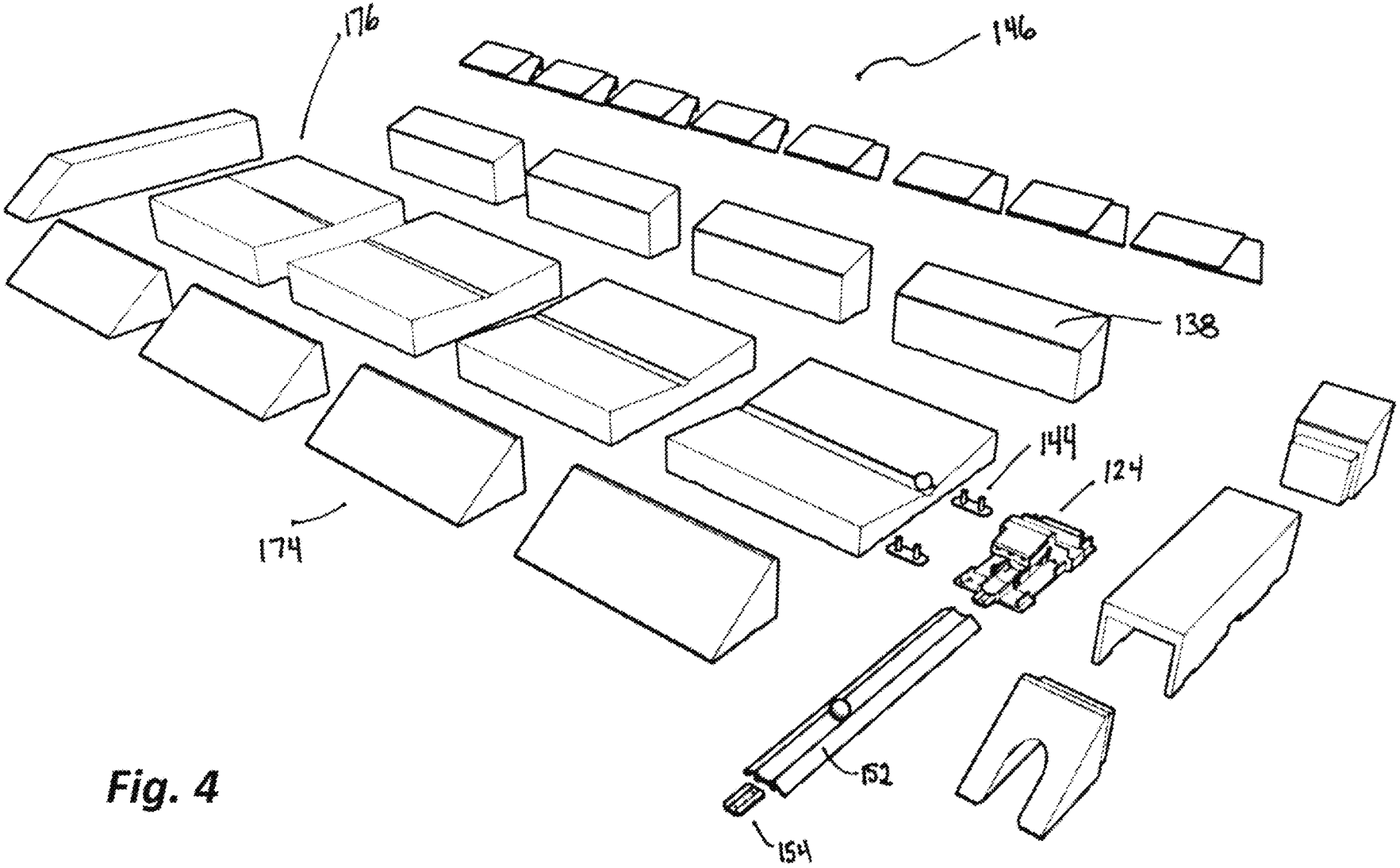
FIG. 4 is an exploded view of some components of an embodiment of the present invention.

FIG. 4 is an exploded view of some components of an embodiment of the present invention. As can be seen, in one embodiment of the invention, the assembly may have numerous configurable components. For example, the ball catcher tray assembly 130 may include foam catcher tray sections and opposite end wall, foam bumpers, rear wall sections 138, and shingles 146. The system may also include a ball launcher cover, ball launcher cover front bumper, ball launcher cover rear wall, and the ball launcher 124 itself. Although not fully shown, the system can further include various track sections 152, some of which may be straight and others of which may be curved and or other shapes, with track connectors 154 serving to connect track sections 152.

It should be noted that in one embodiment the bumpers, catcher tray 122 sections, shingles 146, and or other components may be made of a foam. But other materials may be used either uniformly or in combinations, such as other resilient materials suitable for receiving a ball and providing sufficient cushioning so as to prevent the ball from bouncing away. As examples, various polymers, cork, other woods, rubber, and or other suitable materials may be used instead of foam. There may be an outer cover of sheet material on the sections, if desired.

Figure 5:
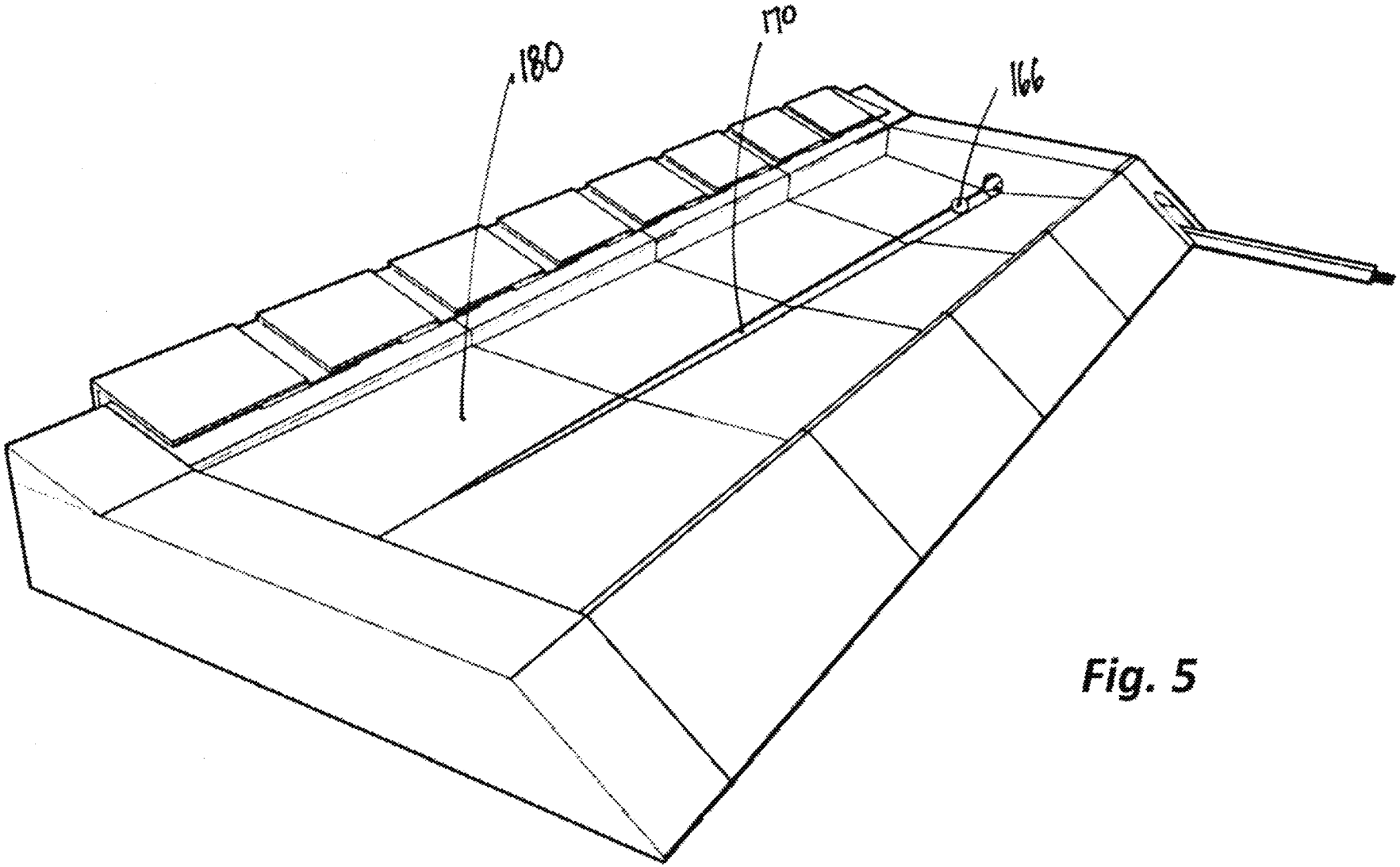
FIG. 5 illustrates a ball catcher tray with sloping top surfaces.

FIG. 5 illustrates a ball catcher tray 122. The ball catcher tray assembly 130 has a progressively downward sloping surface. There is a ball trough groove 170 along which the ball may roll. The progressively downward slope leads to a hole in the ball launcher 124 cover so that the ball may arrive into the ball launcher 124. It should be noted that in this embodiment, the ball rolls toward one end of the ball catcher tray assembly 130. However, in an alternative embodiment, the tray assembly 130 may be angled such that the ball rolls toward an intermediate point such as the middle of the tray 130, or elsewhere. That is, the specific location to which the ball rolls may vary from embodiment to embodiment. The shingles 146 may help guide the ball into the ball catcher tray assembly 130 as gravity pulls the ball down from the simulator screen 120.

Figure 6:
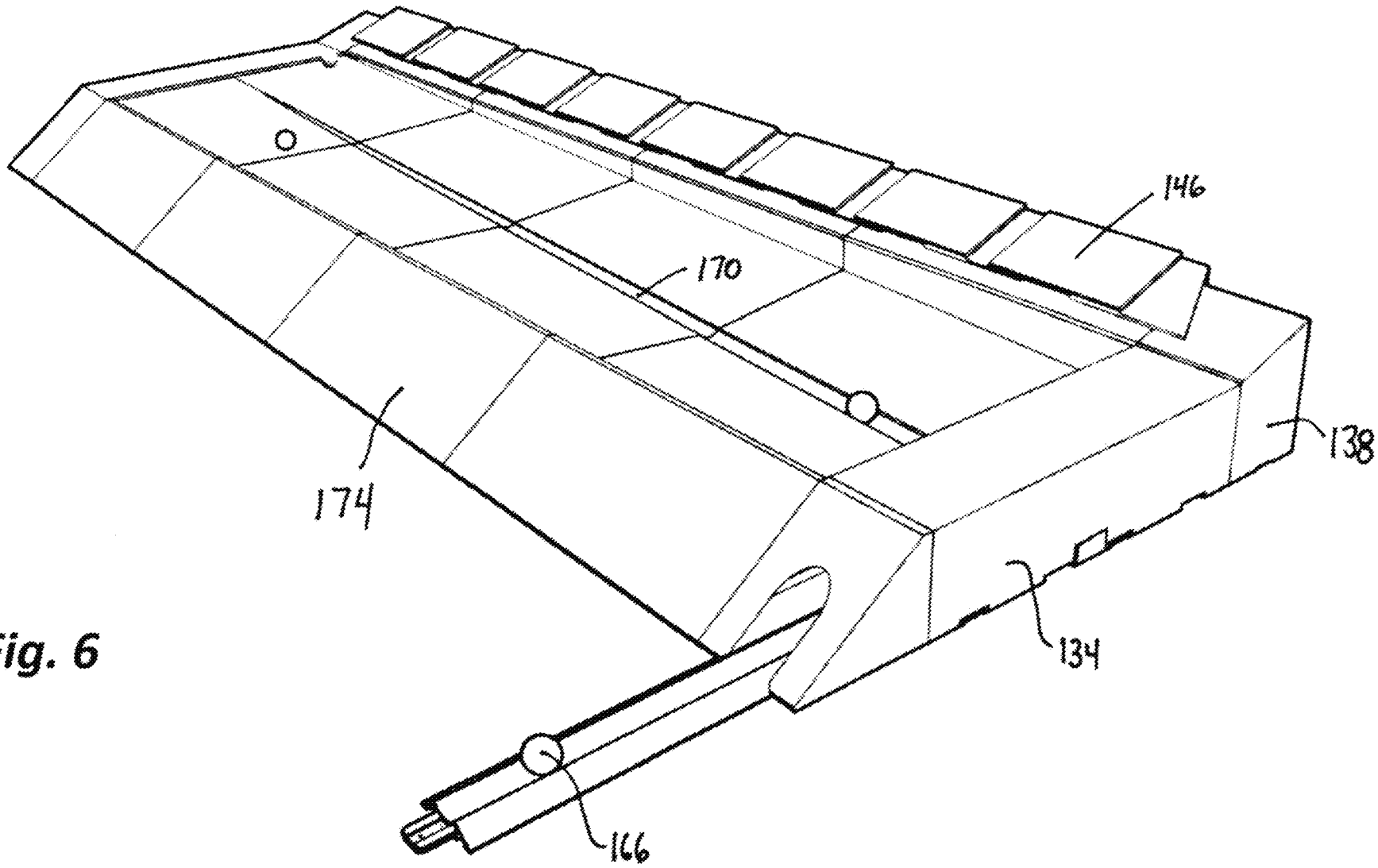
FIG. 6 illustrates golf balls rolling into a ball launcher assembly, and another ball exiting the ball launcher assembly and headed toward the golfer.

FIG. 6 illustrates golf balls 166 rolling into a ball launcher 124 assembly, and exiting the ball launcher 124 assembly and headed toward the golfer 20. As can be seen, in one embodiment the ball catcher tray assembly 130 members both in front and then back are angled toward the middle of the ball catcher tray assembly 130 where the track is located. That way, ball 166 is naturally directed to the track, which itself is sloped towards the hole in the ball launcher cover to be fed to the ball launcher 124.

Figure 7:
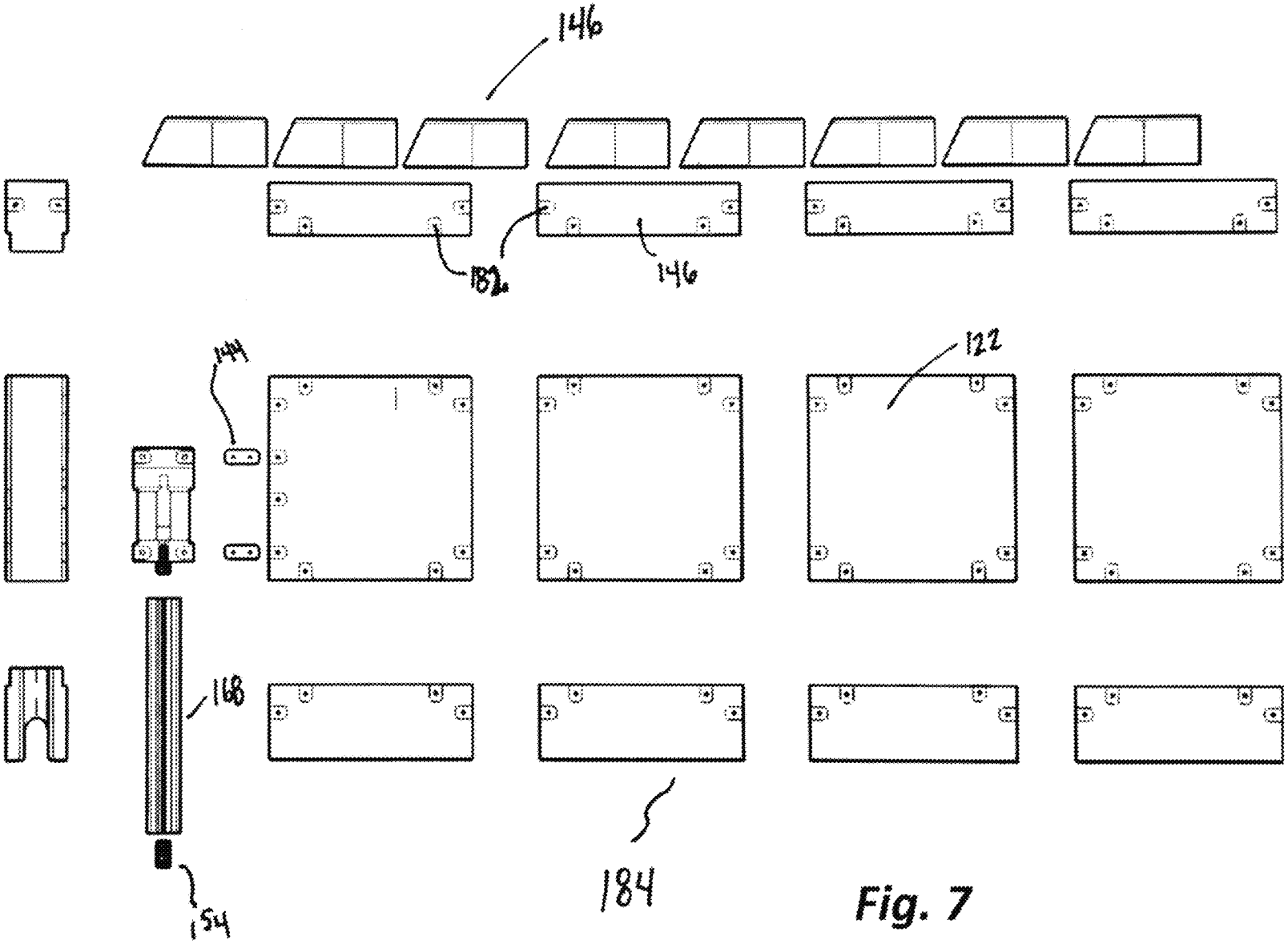
FIG. 7 illustrates various components of the embodiment of FIG. 1, including shingles.

FIG. 7 illustrates various components of the embodiment of FIG. 1, including shingles 146 from an underside perspective, where in a preferred embodiment the sections are connected with connectors 144 inserted into connector pin holes 182.

Figure 8:
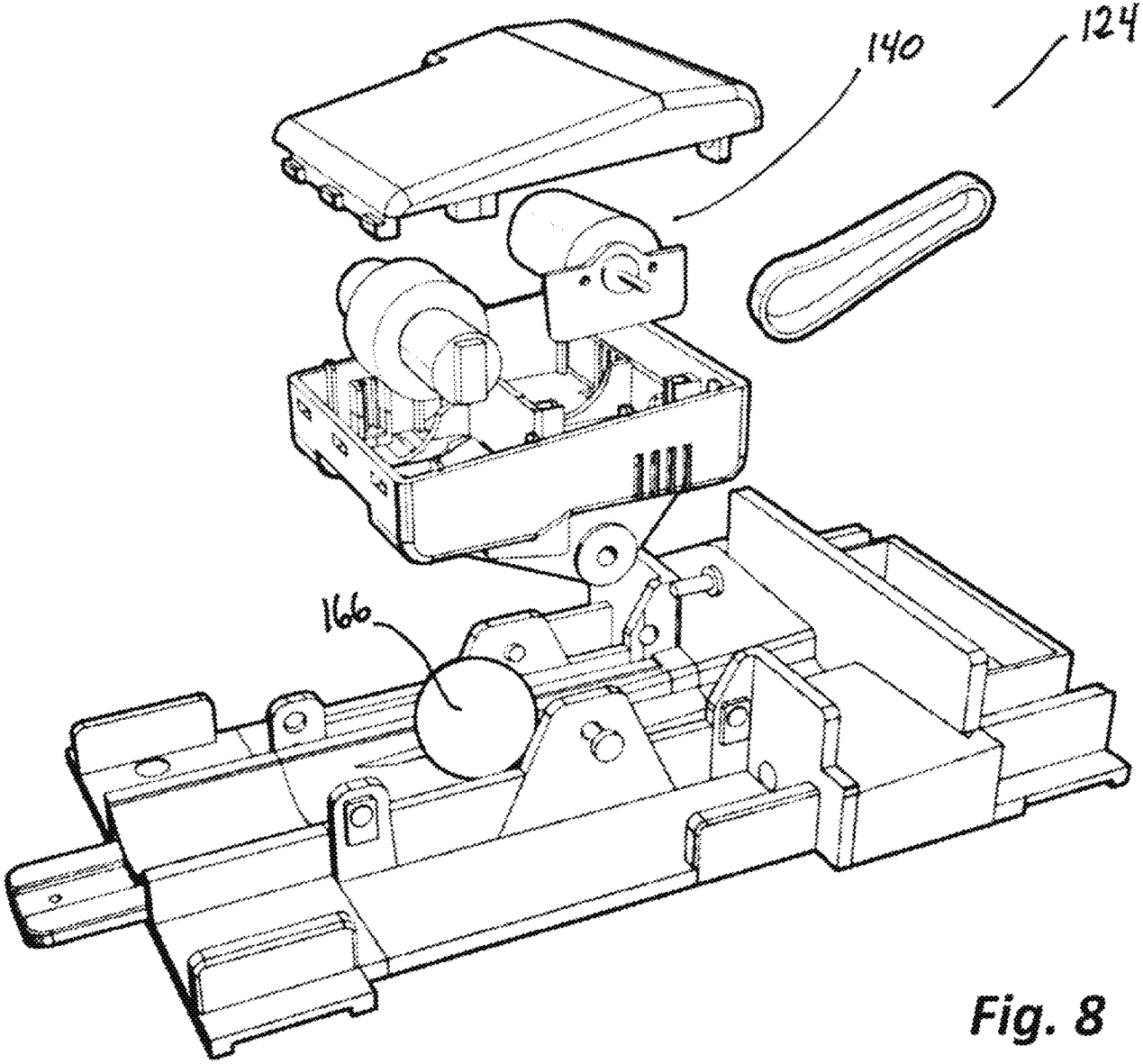
FIG. 8 illustrates components of one embodiment of a ball launcher.

FIG. 8 illustrates components of one embodiment of a ball launcher 124 machine. In this particular embodiment, the ball launcher 124 includes a top lid, a roller wheel 148, a motor 140, and a belt. There is a ball entrance sensor at an entrance to the ball launcher 124, and another sensor at the ball exit. As seen, there is a ball launcher 124 base plate, as well as surfaces that may have downward slopes as desired for the function of the ball launcher 124.

Figure 9:
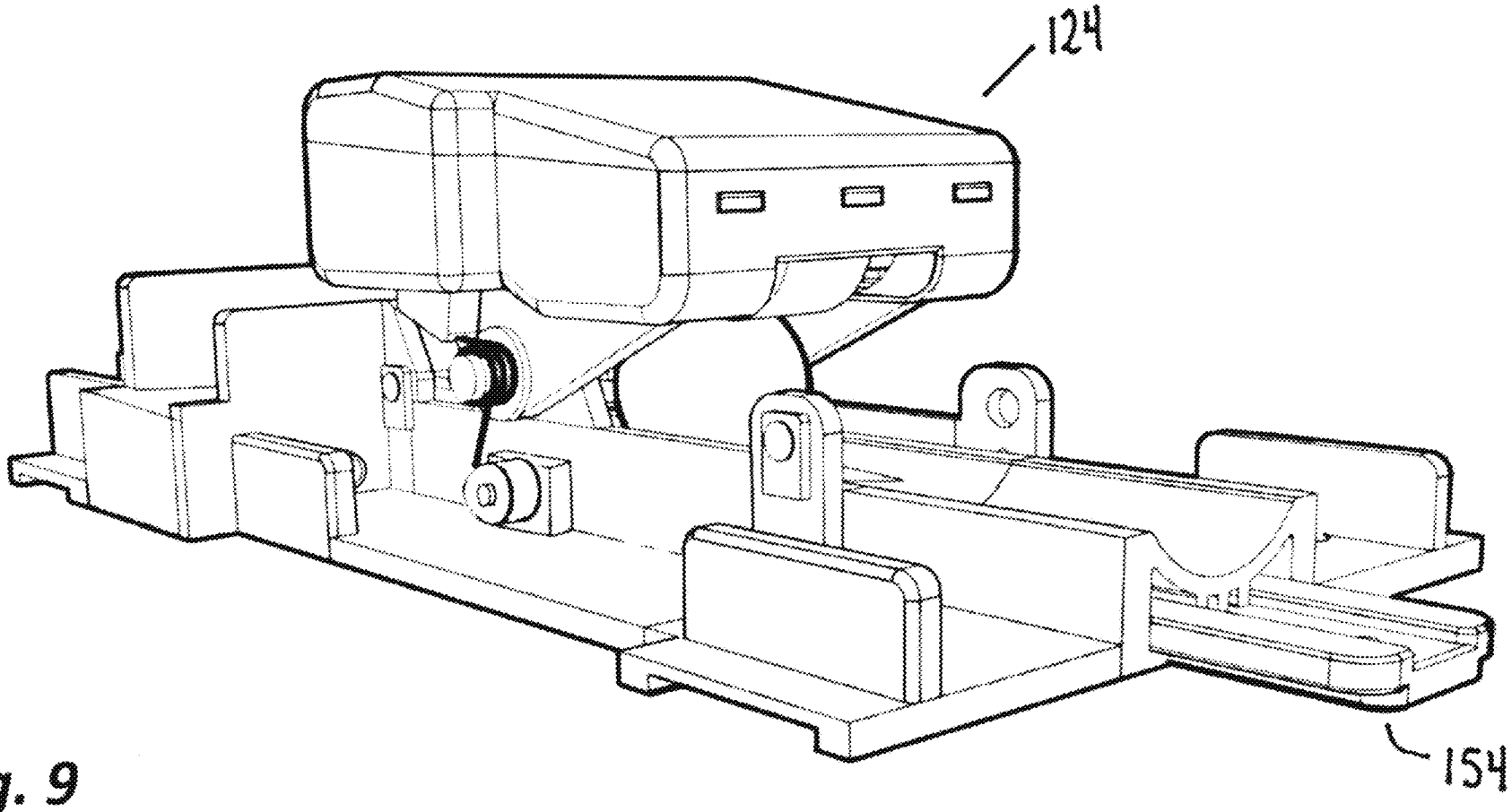
FIG. 9 further illustrates a ball launcher of FIG. 8.
Figure 12:
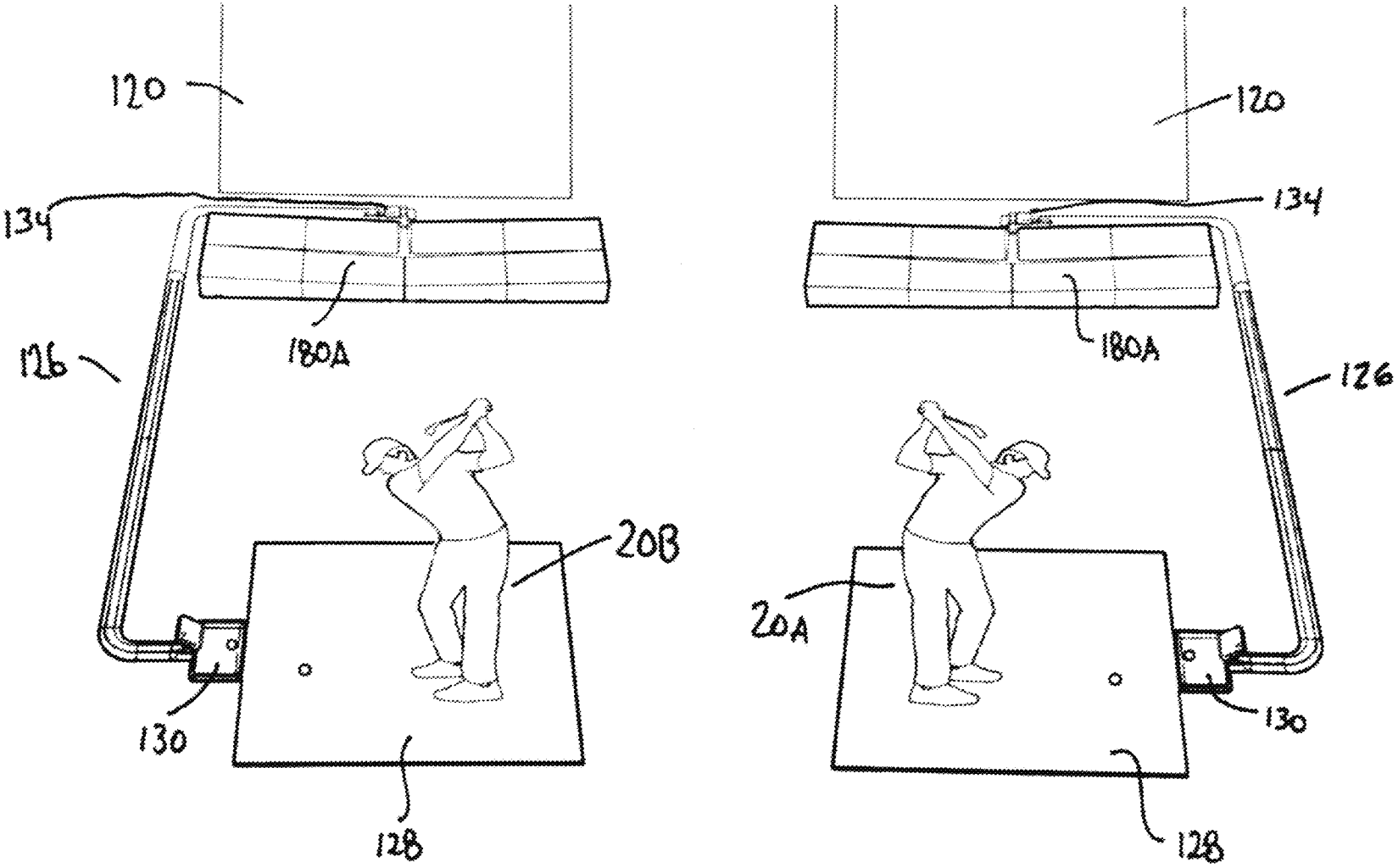
FIG. 12 illustrates left and right-handed versions of an alternative embodiment in which the ball catcher slopes inwardly on both ends toward a center point.

FIG. 9 further illustrates a ball launcher 124 of FIG. 8. As seen, other components may be included in this embodiment, such as a motor 140 housing, a pivot point, a spring, a cam, and other components. A track connector may be provided at the exit of the ball launcher 124 in order to connect a track section 152 at the exit. Typically, the ball will then travel along a plurality of track sections 152 interconnected with one another to form a pathway back to the golfer 20. The track may include straight sections 168, curved sections 164, and/or curved sections with a banked curve 186, as depicted in FIGS. 10 and 12.

Figure 10:
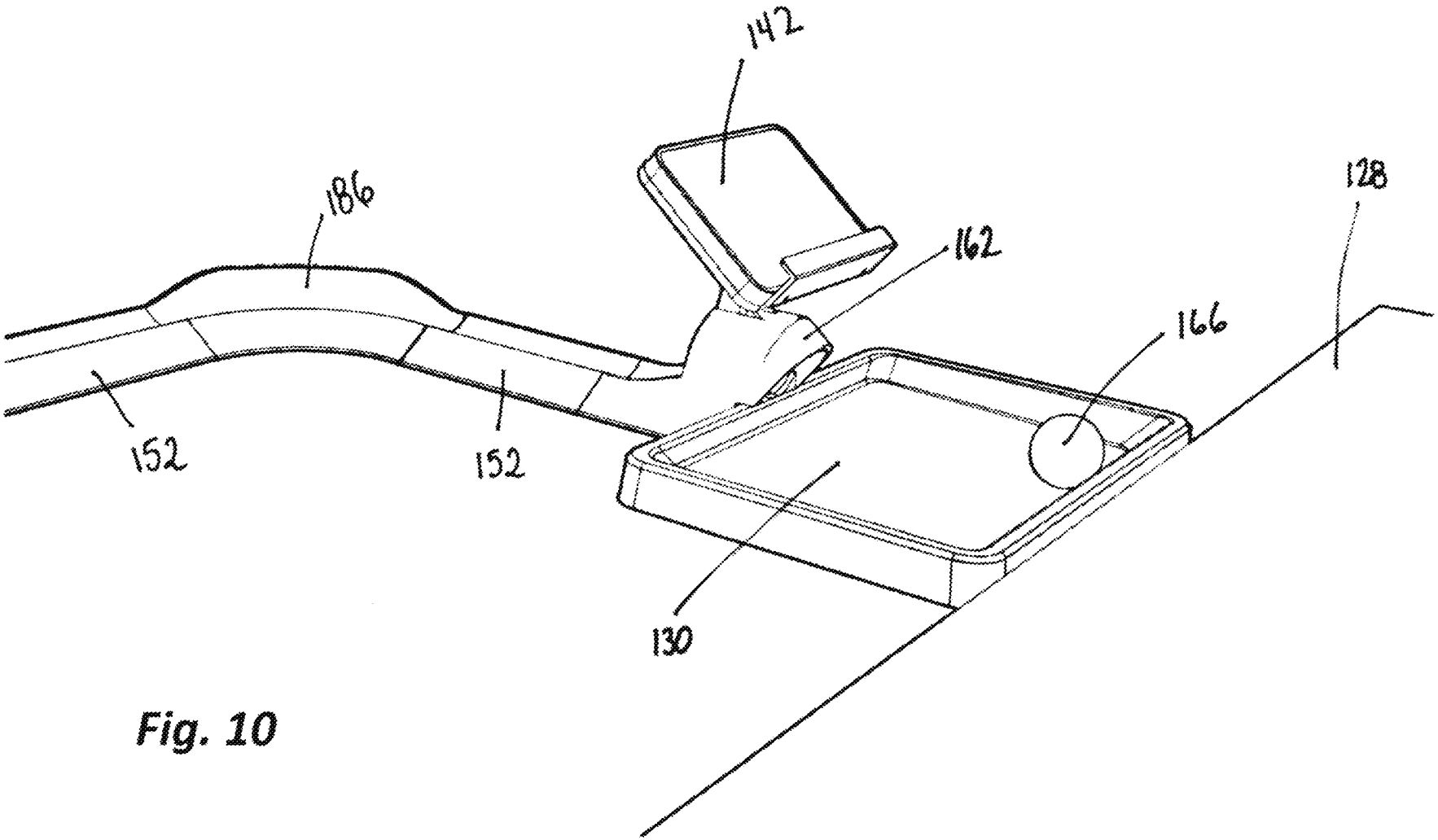
FIG. 10 illustrates an embodiment in which the conduit is a track leading to a ball holding tray.

FIG. 10 illustrates an embodiment in which the conduit is a track leading to a ball holding tray 130. In this embodiment, the ball holding tray 130 is set adjacent to the tee mat 128. Ideally, the golfer 20 may bend over and pick up a ball 166, place it on the mat and hit it toward the simulator screen 120. The ball brake can be seen as immediately adjacent to the ball holding tray 130, such that the ball 166 is slowed down as it travels toward the ball holding tray 130, so as to land in the tray 130 without rolling out. The curved section of the track may have a banked curve 186, so that as the ball travels along the track and around the curve there is additional wall material to help keep the ball on the track as it rounds the curve.

It should be noted that a variety of different conduits may be used within the scope of the invention. Although track sections 152 are presently preferred, other types of conduits such as pipes or other type of pathways may be used as conduits on which the ball can travel. Consequently, the present invention is not limited to using track sections 152.

Figure 11:
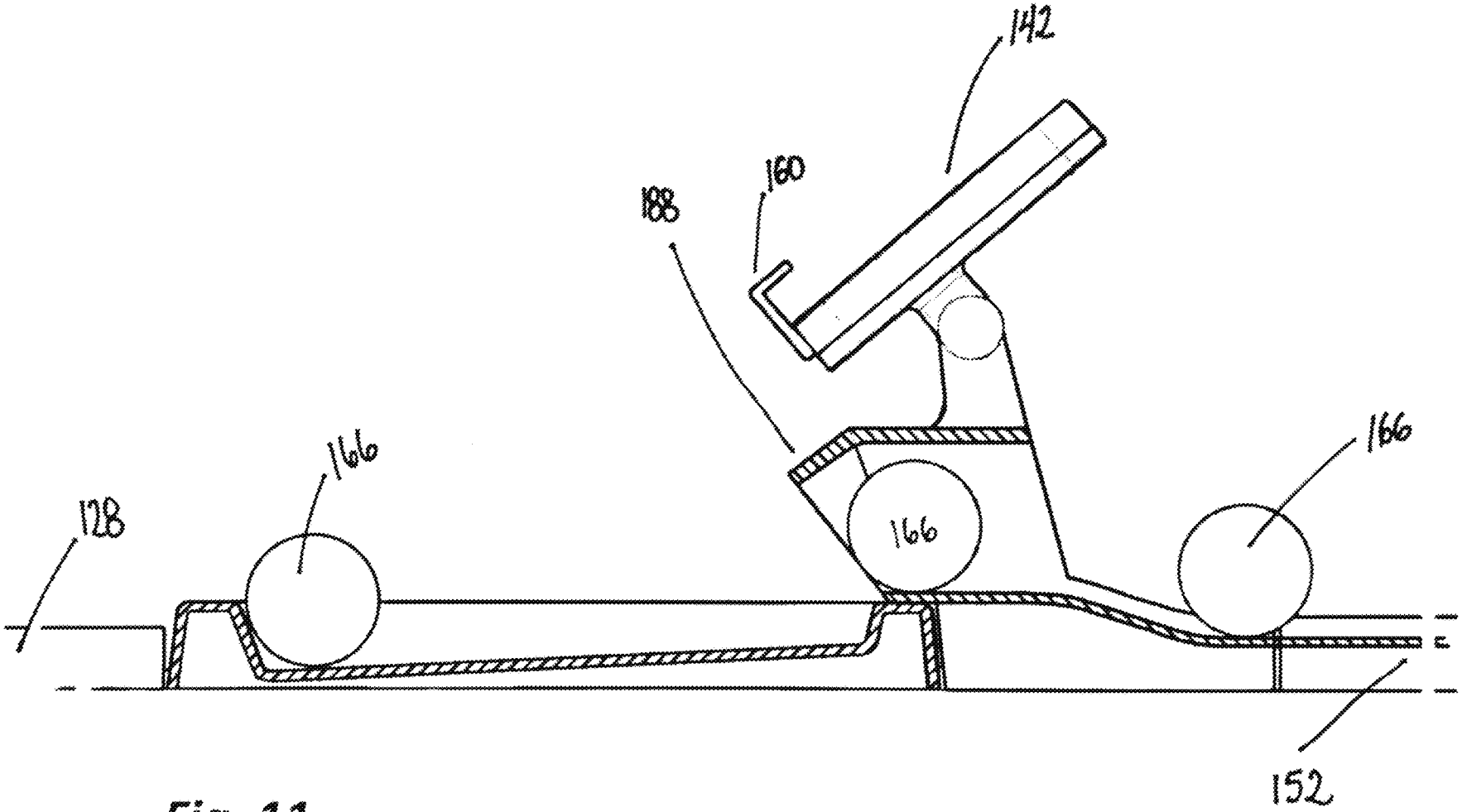
FIG. 11 is a cross section of components illustrated in FIG. 10.

FIG. 11 is a cross section of components illustrated in FIG. 10. In cross section, in one embodiment of the ball holding tray 130 the bottom is sloped toward the end that is adjacent to the teeing mat 128. The ball brake is shown in cross section illustrating one way in which the forward progress of the ball may be slowed prior to entering the ball holding tray 130. The ball rolls into the ball brake, contacts the molded deflector 188, slows or stops its forward momentum, then drops down onto the holding tray 130 and, preferably, slowly rolls forward. The ball brake may be made from any of a variety of materials, although a molded polymer is the presently preferred material.

FIG. 12 illustrates left and right-handed versions of an alternative embodiment in which the ball catcher slopes inwardly on both ends toward a center point. In this embodiment, the track sections slope downwardly towards the center, providing an alternative track assembly 126 for either right or left-handed golfer 20*s*. In this embodiment, the ball launcher 124 is located at the back of the ball catcher tray assembly 130 rather than along the side. A track section 152 then extends from the ball launcher 124 along a portion of the back of the ball catcher tray assembly 130 on its way toward the golfer 20. As with other embodiments, the golfer 20 may be right-handed or left-handed and the location of the mat may be changed such that it is at an angle to the simulator screen 120 rather than directly in front of it. The sectional, modular nature of the track assembly 126 allows the ball holding tray 130 to be placed wherever it is needed considering the location of the teeing mat 128.

Figure 13:
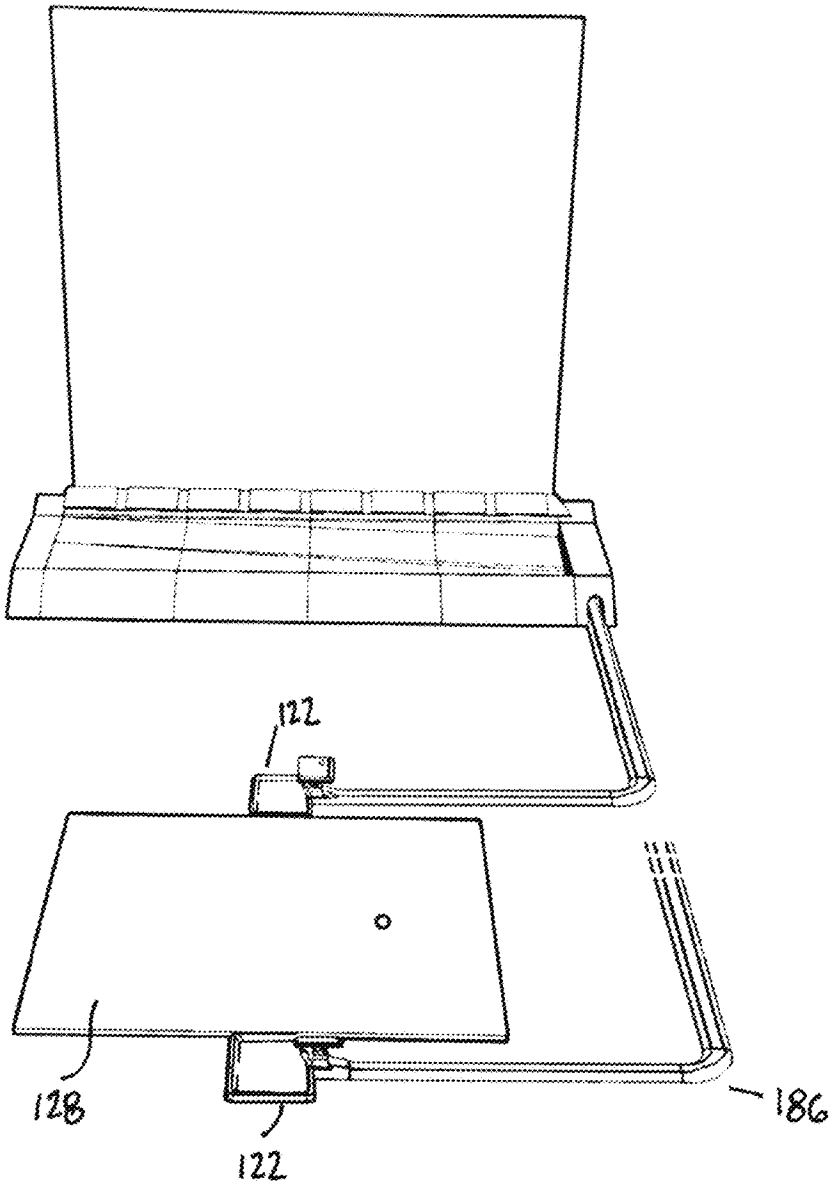
FIG. 13 illustrates an alternative embodiment in which the ball tray may be placed in front of and/or in back of the mat rather than to one side.

FIG. 13 is an alternative embodiment in which the ball tray 130 may be placed in front of and/or in back of the mat 128 rather than to one side. When the ball holding tray 130 is located in front of the teeing mat 128, the user may wish to omit the control panel so that the possibility of the golf ball hitting the control panel is reduced. Alternatively, the control panel may be provided with a hinge (not shown) so that it may be folded flat against the ground to avoid being hit by the golf ball. Again, in a preferred embodiment the geometry of the track and location of the ball holding tray 130 and control panel are all variable.

Figure 14:
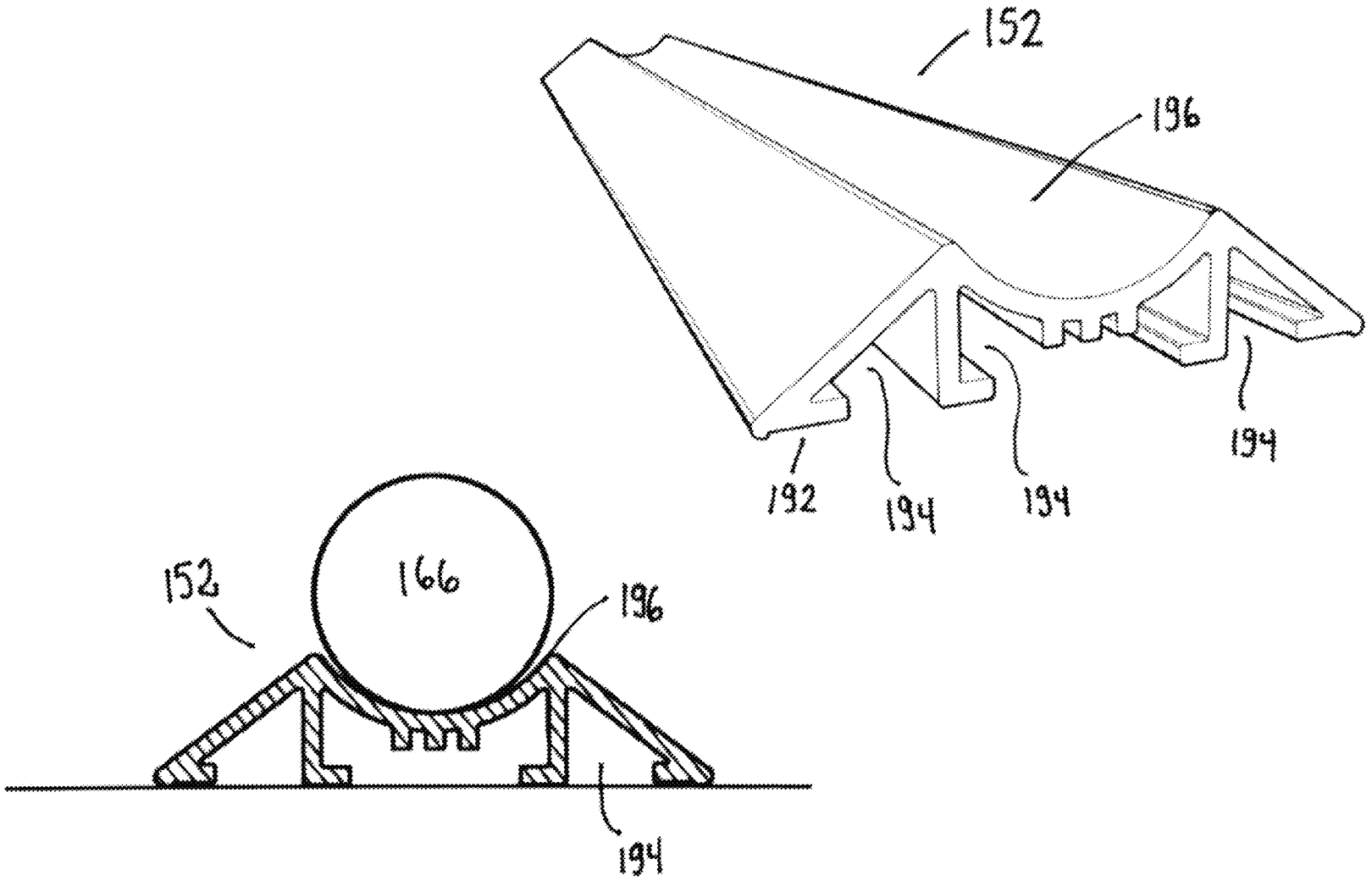
FIG. 14 includes a cross-section of a track portion.

FIG. 14 includes a cross-section of a track portion. In this specific embodiment, the track has a space 194 in which wires can run on the underside of the track cavity. In this embodiment, the track includes a curved portion 196 through which the ball rolls. In one approach, double sided tape or another type of securing mechanism may be attached to the underside 192 of the track to secure it to the floor. Optionally, the track may be bolted or otherwise secured to the floor for more permanent installation, although fixed insulation is not always desired in particular cases.

Figure 15:
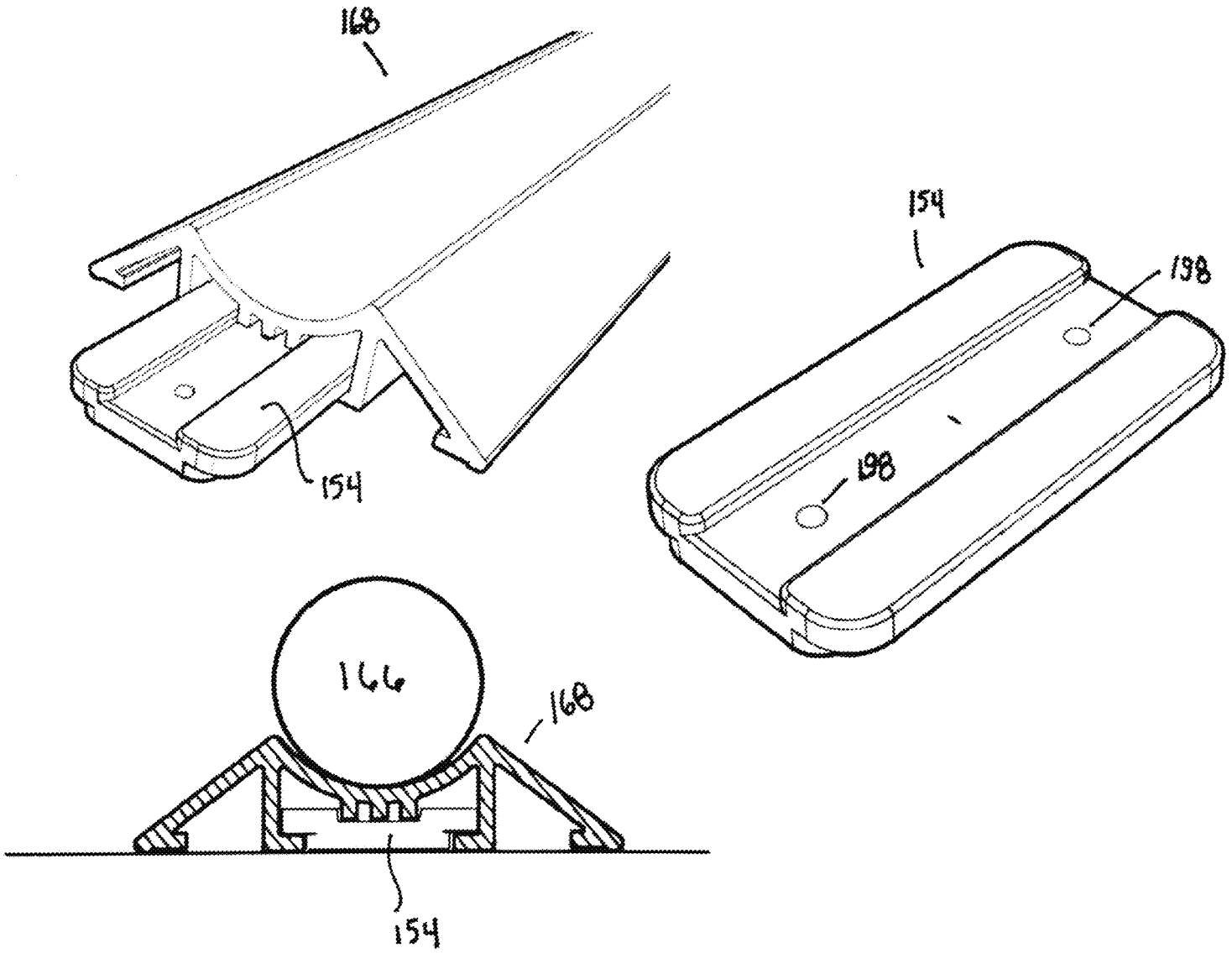
FIG. 15 illustrates the track portions of FIG. 14 in which sections of the track are connected with connectors.
Figure 16:
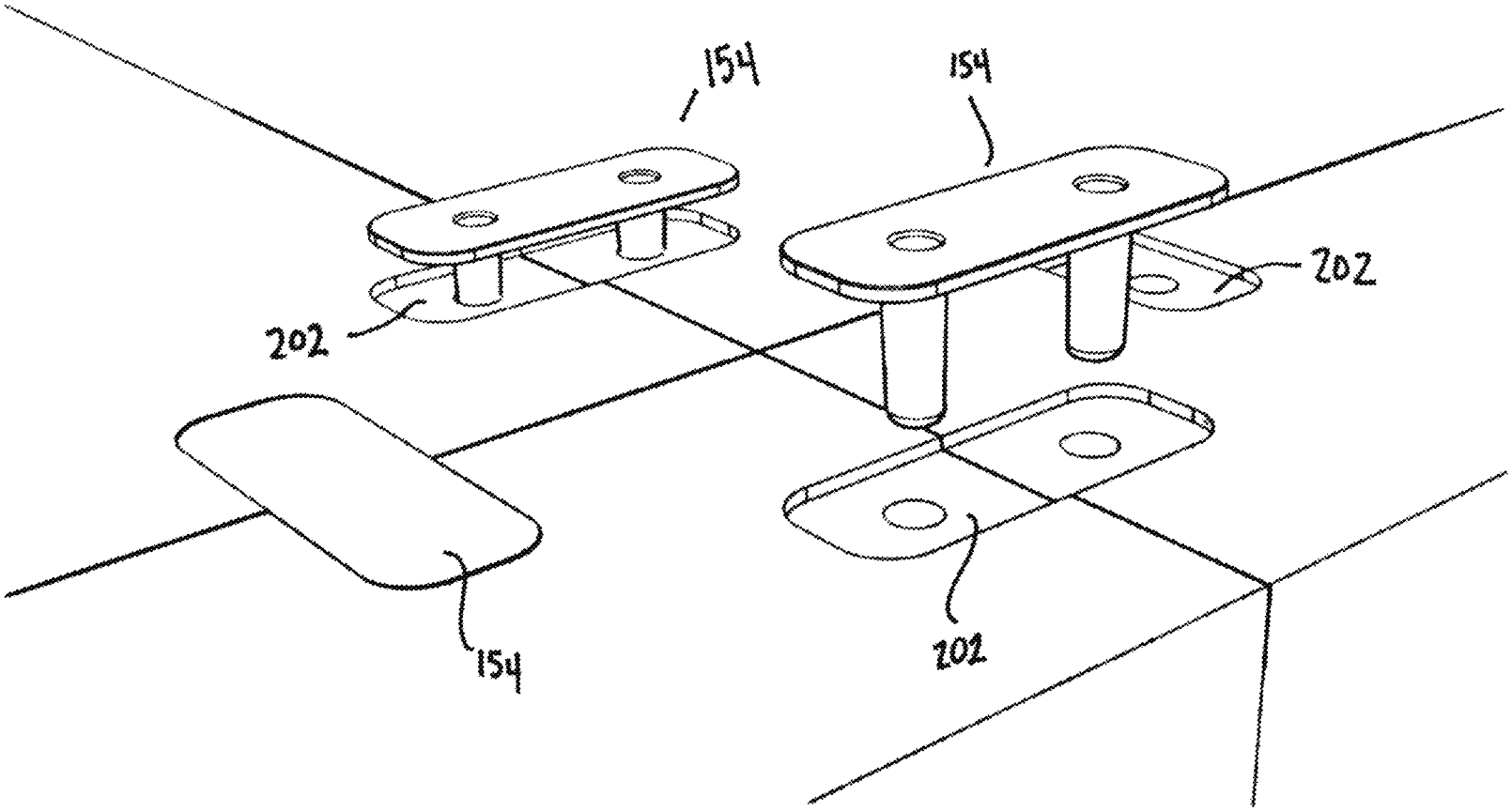
FIG. 16 illustrates ball catcher trays interconnected with connector pins.

FIG. 15 illustrates the track portions of FIG. 14 in which sections of the track are connected with connectors 154. The track pieces may be connected with connectors 154. The connector may have a groove in the center in which a portion of the track piece or section engage. In this way track sections 152 may be easily connected, as desired. It should be noted that various other arrangements may be made for connecting track sections 152. For example there may be clips and receiving grooves directly on the track pieces such that they connect directly without connectors 154. Track sections 152 may alternatively have hook and loop material at the end so that the track sections 152 may be stuck together without separate connector pieces. Various approaches to connecting track pieces fall within the scope of the invention FIG. 16 illustrates ball catcher trays 130 interconnected with connector pins 144. The pieces of the ball catcher trays 130 may be held together in a variety of ways. One way is with connector pins 144 that fit into detents in the ball catcher trays 130 on the underside. These molded connector pins 144 may, for example, snap into the edges of the detent, or alternatively may simply be held in place through friction or other means. Other arrangements may be used to connect the foam tray pieces 130 of the ball catcher such as tape, hook and loop material, or other connecting means known in the art.

Figure 17:
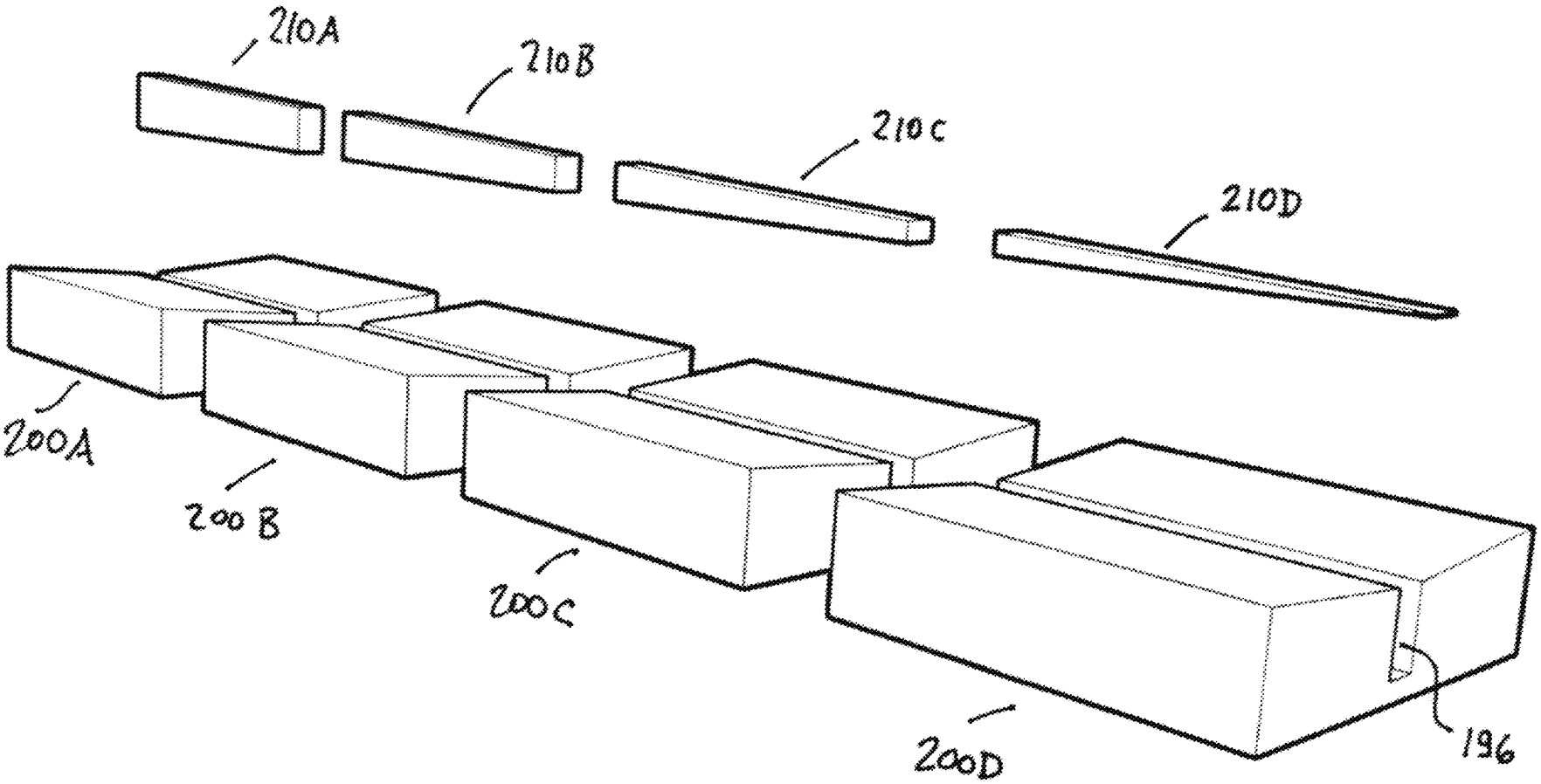
FIG. 17 illustrates one approach to creating a slope in a ball catcher assembly using wedge shaped ramp sections inserted into identical ball catcher tray foam sections.

FIG. 17 illustrates one approach to creating a slope in ball catcher assembly using differing wedge shaped ramp sections. The downward slope in the ball catcher tray assembly 130 may optionally be created with a series of ramp progressively differing sections 210A, 210B, 210C and 210D. In this figure, the ramp sections 210A-D are shaped as wedge pieces. In sequence, the wedge pieces create a downward sloping surface along which the ball will roll. These wedge shaped ramp sections may be inserted into troughs formed within identical sections of the ball catcher tray assembly 130. This preferred embodiment would be more economical to manufacture and commercialize than requiring each of the foam sections to be individually shaped, as illustrated in FIG. 4 of this application.

Using ramp sections, various other slopes can be created, such as a pattern that directs the ball toward the center of the ball catcher tray assembly 130 rather than to one end. The wedge shaped ramp sections may be made of the same material as the sections of the ball catcher tray assembly 130, or may be made of a different material adapted to allow the ball to roll more quickly down the ramp. In one preferred embodiment, the ramp sections 210 are removable, although in other embodiments they may be glued or otherwise held into place once inserted into the respective troughs of the ball catcher tray assembly 130.

Figure 18:
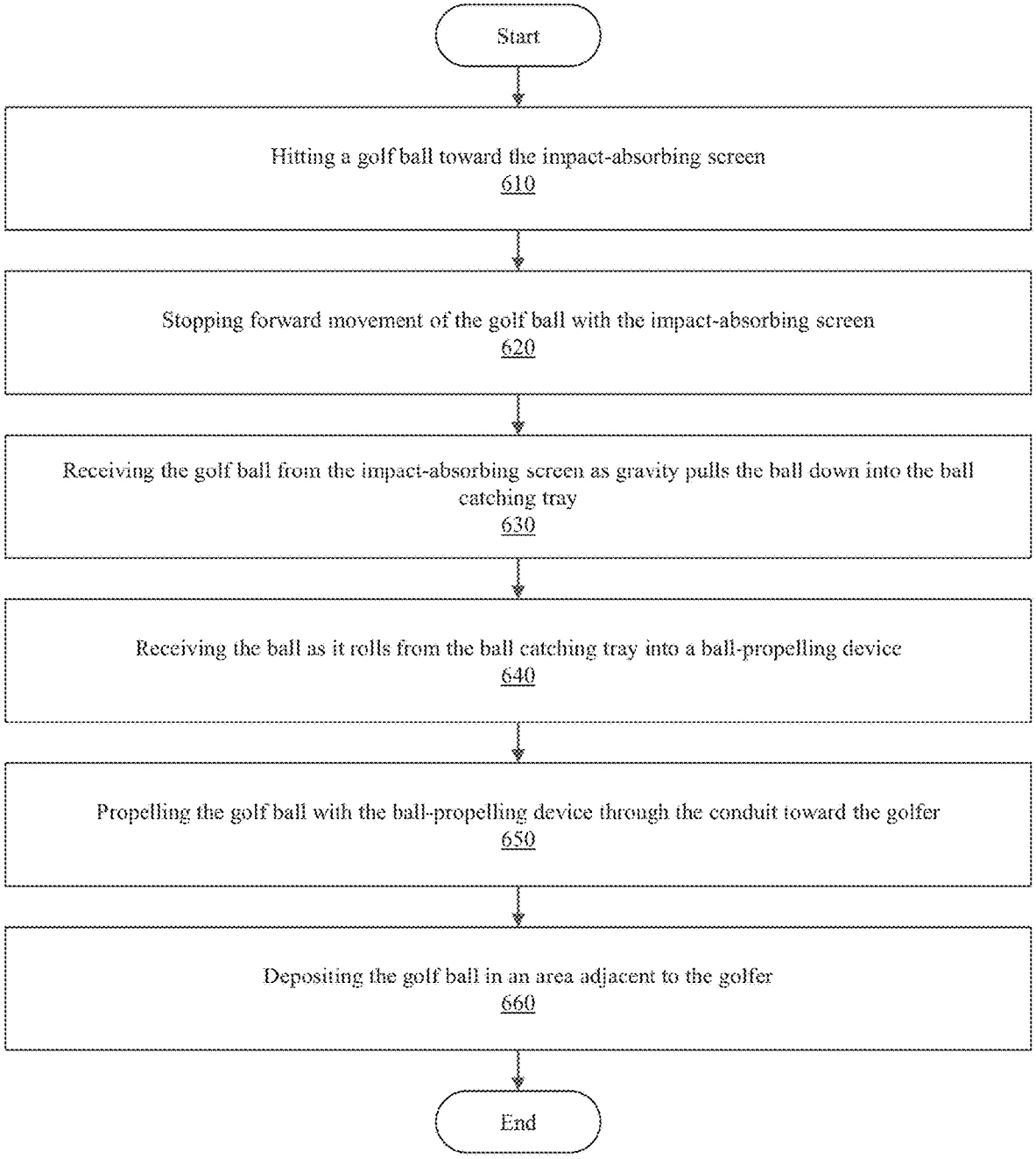
FIG. 18 is a flowchart illustrating a method of returning a golf ball to a golfer in simulated golf play, according to some embodiments of the present disclosure.

Considering now methods according to some embodiments of the present invention, FIG. 18 is a flowchart that describes a method of returning a golf ball to a golfer in simulated golf play, according to some embodiments of the present disclosure. At 610, the method may include hitting a golf ball toward the impact-absorbing screen. At 620, the method may include stopping forward movement of the golf ball with the impact-absorbing screen. At 630, the method may include receiving the golf ball from the impact-absorbing screen as gravity pulls the ball down into the ball catching tray. At 640, the method may include receiving the ball as it rolls from the ball catching tray into a ball-propelling device. At 650, the method may include propelling the golf ball with the ball-propelling device through the conduit toward the golfer. At 660, the method may include depositing the golf ball in an area adjacent to the golfer.

In some embodiments, an impact-absorbing screen for receiving golf balls that the golfer may hit at it, employs a modular golf ball return system. A plurality of sections that when connected together form a ball catching tray below the impact-absorbing surface, a ball propelling device, and a modular conduit leading from the ball-propelling device to the golfer, the conduit. A plurality of conduit sections which when connected together form the conduit. The steps of, the method may include 610 to 660.

In some embodiments, the system includes a speed control to vary a speed of ball return. In some embodiments, the golf ball return system may further have shingles coupled with the trough or tray adapted, for example, to couple with or adjoin a lower portion of the impact-absorbing screen. In some embodiments, the ball-propelling device may have an exit end from which a propelled golf ball exits, and the conduit comprises sections, at least one of the sections of the conduit coupled to the ball-propelling device. In some embodiments, the sections of the conduit may comprise straight sections and curved sections. The sections may be connected in a chosen sequence. In some embodiments, the ball return system may include at least one of a control panel having an electronic controller, a display screen, a sound system, and control knobs.

Figure 19:
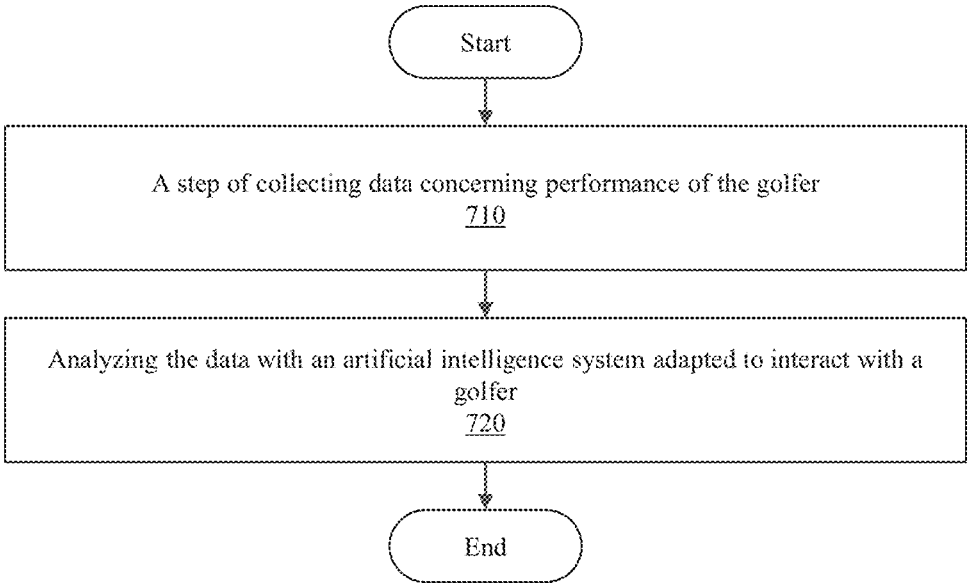
FIG. 19 is a flowchart further illustrating the method of returning a golf ball to a golfer in simulated golf play, according to some embodiments of the present disclosure.

FIG. 19 is a flowchart that further describes the method of returning a golf ball to a golfer in simulated golf play from FIG. 18, according to some embodiments of the present disclosure.

Figure 20:
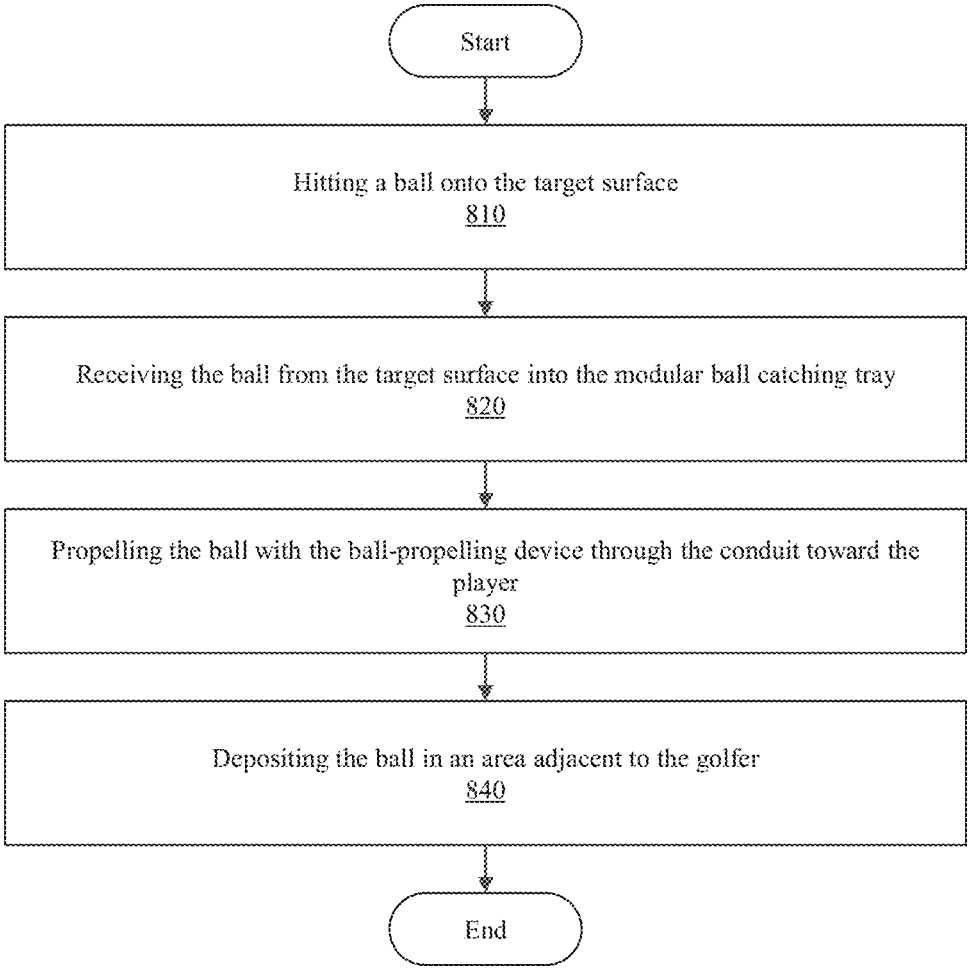
FIG. 20 is a flowchart illustrating a method of returning a ball to a player in a simulated sports game system, according to some embodiments of the present disclosure.

FIG. 20 is a flowchart that describes a method of returning a ball to a player in a simulated sports game system, according to some embodiments of the present disclosure. In some embodiments, at 810, the method may include hitting a ball onto the target surface. At 820, the method may include receiving the ball from the target surface into the modular ball catching tray. At 830, the method may include propelling the ball with the ball-propelling device through the conduit toward the player.

Having considered general aspects of embodiments of the present invention, we will now consider optional details concerning various components of some embodiments. It should be kept in mind that the following paragraphs describe non-limiting specific examples and details, but that variations fall within the scope of the invention.

The ball catcher tray 122 can sit adjacent to and below the simulator screen. Generally horizontally movable shingles 146 are Velcro (hook and loop fastener) or tape attached, or glued or sewn or otherwise fastened to the bottom of the Simulator screen. The shingles 146 are (further described in detail, below) thereby able to move fore and aft as they rest atop the rear section of the invention's ball catcher tray 122. This unique design allows the Simulator screen to move forward or backward as it absorbs the impact of a launched golf ball.

Meanwhile the shingles 146 provide a movable contiguous surface for the ball as it drops down into the ball catcher tray 122. The shingles 146 eliminate the potential for the ball to miss falling into the tray 130. Alternately although less preferred, the multiple smaller shingles 146 could be replaced by one long movable shingle 146.

In one embodiment, every ball catcher tray 122 section has a progressively lower sloping top surface so that, when the tray 130 is assembled, the ball will roll smoothly downward in one direction in a trough area of each tray 130 section, towards the ball launcher 124 unit. During the assembly process the lowest sloped tray 130 is best being first connected to the ball launcher 124 unit and then the other tray 130 sections are consecutively attached so that the ball will always roll down towards the ball launcher 124.

Depending upon the width of the simulator screen, the following number of tray sections may be utilized, for example: 4 tray sections=8 feet end to end, 3 tray sections=6 feet end to end. These are merely illustrative examples, and may be altered for particular uses.

The ball catcher tray 122 is best constructed of durable, impact-absorbing foam, such as polyurethane or polypropylene foam, or equivalent, to absorb a good deal of the bounce of the ball as it drops down after having contacted the simulator screen. The foam may optionally be covered with a thin, durable cover of protective sheet material.

The ball holding tray 130 is conveniently reversible in its left or right orientation, so the golfer 20/owner can position the tray 130 to best accommodate ball return side, depending upon whether the golfer 20 is right or left-handed Although the owner of the invention might have assembled the unit to best accommodate a right-handed golfer 20, anyone can enjoy the invention as a left-handed golfer 20 would simply have the ball returned behind him, and he would turn around and move the ball with his club or his hand to reposition it for his next shot.

An alternative design of the ball catcher tray 122 can route the ball via declining angles toward the center of the tray 130, and then away from the golfer 20, downward to the ball launcher 124 positioned behind the ball catcher tray 122. The ball launcher 124 is positioned behind the ball catcher assembly, oriented towards the left or right, depending on the golfer 20's handedness and which side he prefers the ball to travel back. Track sections 152, including a 90 degree curve section would direct the ball, propelled out of the ball launcher 124 and onto the track where the ball will eventually arrive at the ball holding tray 130.

It should be noted that an advantage to utilizing a motor 140 and ball launching mechanism to launch the ball down the track, instead of simply utilizing gravity to roll the ball down the track is that, in the event a user desired to assemble and install the invention with an under-floor ball track, it would be necessary for the ball to be traveling with greater momentum so as to not fail to elevate back up the floor height for delivery into the ball holding tray 130.

The ball launcher 124 unit coupled to the ball catcher tray assembly 122 is covered by a preferably impact-resistant foam housing cover. The cover is three sided with two generally open ends. One long side of the cover contains an open portal through which the ball can roll into the ball launcher 124 unit.

The ball launcher 124 unit housing cover is intentionally symmetrical so that it can be utilized by golfer 20 who will assemble the invention for right or left handed ball return. Ball launcher 124 is also comprised of a front cover bumper and ball launcher 124 cover rear wall.

At the highest side of the foam ball catcher tray assembly 122 there will be another section of molded foam to function as an opposite end wall to keep the ball in the foam tray 130.

The modular foam sections of the ball launcher 124 are easily fastened one to another by means of unique connector fittings that in a preferred design are comprised of a flat section bearing two small pins that can be press fit into a coordinated recess with two small holes, molded into the bottom of foam tray assembly 122 pieces. The connector fittings can be approximately 4" long by 1.5" wide. The pins are approximately 2" high and ½" diameter. These dimensions can vary.

The use of the described pins and connector fittings is preferred over screws, Velcro (hook and loop fastening), nails, magnets etc. because the connector fittings provide secure attachments while still allowing for easy disassembly if the user either wants to relocate or adjust the completed ball catcher tray assembly 122, or move the entire invention to another location. However, various different connectors may be used, depending on user preferences.

It should be noted that the same pins and connector fittings can also be employed in the assembly of plastic parts to foam parts, such as when assembling the (foam) ball catcher tray assembly 122 to the (plastic) ball launcher 124 unit.

In front of every 2-foot-wide foam ball catcher tray 122 section, including the two opposite foam end sections, is a sloping foam bumper section also attached via similar connector fittings. These sloping foam bumper sections are separate from the other foam sections of the ball catcher assembly because the sloping foam bumpers pieces would need to be in reverse position (relative to the tray assembly 122 sections) in the event the invention was assembled to accommodate ball return for left-handed golfer 20*s* The sloping foam bumper height is higher than the height of the modules comprising the ball catcher assembly to prevent an active golf ball from rolling off the foam catcher tray assembly 122 sections. It should be noted that the design of the foam sections as specifically described herein applies to one particular embodiment of the invention, where the foam sections are unique one to another.

Utilizing the same pin and connector fitting pieces of the invention, also attached against the back edge of each section of the ball catcher tray assembly 122 are foam rear wall sections 138 to prevent an active ball from rolling up and off the ball catcher tray assembly 122. The rear wall sections 138 also function as a landing place for movable molded shingles 146, described immediately below, that provide surface continuity between the bottom of the Simulator screen and the invention. Alternately, the shingles could rest directly upon the slope of the foam sections.

Molded foam shingles 146, preferably 1 foot wide although wider or narrower depending on the unit, are attached in proximity to the bottom edge of the Simulator screen, preferably by hook and loop fastener material commonly referred to as Velcro. Alternatively the shingles 146 can be attached to the Simulator screen (or other vertical target surface for the ball, as earlier described) by glue, or pins, or other fastening means. The molded foam shingles 146 are preferably shaped to include a flange section positioned behind and below the back edge of the rear wall sections 138. The shingles 146 are preferably not fixably attached to the rear wall sections 138 of the ball catcher and instead simply rest on the top sloped wall of the ball catcher sections. This is preferred as experimentation has proven the capture and directing of the golf ball is best achieved when the Simulator screen is free to move backward to absorb the impact of the golf ball and then slide back into its foremost location while not creating a gap between the Simulator screen and the ball catcher tray assembly 122.

The shingles 146 are preferably 12" wide and 9" deep. Alternative dimensions are possible. It is understood that the design and intent is that the functional horizontal depth of each shingle 146 will functionally increase to the shingle 146's overall depth during the ball's launch, screen-strike and roll-down event, as the Simulator screen will move backwards upon impact of the ball onto the Screen. This inventive design functions well to provide consistency of ball catching when compared to third party products designed to catch a ball via any other non-impact-absorbing method of moving-ball capture and return. It should be noted that third party golf ball catching inventions will often utilize nets, as described earlier, to achieve impact absorption, however nets typically are unreliable in assuring that the slowed-down ball will not get trapped and entangled in such a net and fail to continue to any downstream location, thereby negating any effective or consistent ball return to the golfer 20.

In a preferred embodiment, once a ball rolls down into the sloping section of the ball catcher, it will then roll through the hole in the ball catcher tray assembly 122 (described above) and will enter a short declining plastic ramp section of the ball launcher 124 assembly. At the end of the short ramp section the ball makes a 90 degree turn, and its direction of travel changes from being parallel to the Simulator screen to being perpendicular to the screen, the ball now heading towards the golfer 20.

Inside the ball launcher 124 assembly is an electric motor 140 as earlier disclosed, preferably infrared sensors (an alternative can be an electro-mechanical switch), a drive wheel or wheels attached to the motor 140 either directly or by way of a gear or belt assembly, a circuit board or similar electronic control unit 142, and subordinate components such as belts, gears, screws, etc.

In one embodiment, the primary circuit board is contained in the ball catcher tray assembly 122 and an addendum circuit board, described later, would be contained in the control unit 142 in closer proximity to the golfer 20. The two circuit boards would be wire-connected one to another via under-track wiring. Alternatively wireless communication could be achieved via Bluetooth, infrared or radio signal, as commonly known to those skilled in the art. Wired connection is preferred as often multiple wireless signals from other devices and even multiple units of this very same invention could potentially interfere with system components communicating one to another. It should also be noted that the primary circuit board could be contained in the control unit 142 and the addendum circuit board could be contained in the ball launcher 124.

The electric motor 140 can be battery-powered however the preferred embodiment, for consistent operation, is electric powered by means of house current converted to direct current via a transformer. The transformer providing electrical power supply to the motor 140 is preferably located in or in near proximity to the ball launcher 124. Alternatively, the transformer could be located in or near the control unit 142, described later. The motor 140 could preferably operate on 3 to 12 volts of DC (direct current) power. If desired, the motor 140 and the entire system could operate on AC (alternating current) electrical power.

The ball launcher 124 is manufactured from injection molded plastic (ABS or polypropylene, or other similar high quality impact-resistant moldable plastic). The preferred embodiment of the ball launcher 124 has a molded bottom plate and a pivoting motor 140 housing section. Alternatively the motor 140 could be fixably attached to the bottom plate.

The rolling ball would be launched forward by it coming into contact with a soft foam roller 148 wheel or wheels within the ball launcher 124. The roller 148 wheel(s) are comprised of soft flexible polyurethane (or equivalent) foam, or rubber, and coupled to the shaft of the motor 140 either directly or via a simple gear or belt assembly commonly known to those familiar with motor 140-driven gear mechanisms. In a preferred embodiment the roller 148 wheel is positioned above the ball to impart downward forward roll to the ball. Alternatively, two roller 148 wheels can be positioned one on either side of the ball's pathway to impart forward motion. The two roller 148 wheels would each be activated to spin by being coupled to the motor 140 via gears or belts as commonly known those skilled in the art.

In the preferred embodiment where the motor 140 housing element is positioned above the path of the ball, the motor 140 housing element is pivotably attached to the bottom plate of the ball launcher 124 assembly, and the motor 140 housing element is held under tension via spring tension to bias it downward, assuring contact with the ball. The motor 140 housing element can be restrained from complete downward movement by virtue of molded stops on the bottom plate or by an additional spring coupled to the base plate to offset the tension of the primary tension spring attached to the pivoting motor 140 housing.

Spring tension(s) could be user-adjustable via a cam(s) or set screw(s) in the rare event that the tension between elements requires increased or decreased tension against the ball. An alternative to the foam roller 148 wheels contacting the ball to propel the ball forward could be a flexible drive belt positioned above the ball to come into contact with the ball once it has rolled into the ball launcher 124 assembly.

The drive belt may be powered by an electrically powered motor 140 generally as earlier described, although other drive mechanisms are possible.

It should be noted that all pathway components, from the ball catcher tray 122 and the ball pathway within the ball launcher 124 prior to its contact with any roller 148 wheel, may be sloped in a downward direction so that even with power off the ball will not come to rest prior to its contact with any roller 148 wheel(s). Small bubble levels can be provided for the user to confirm that the ball launcher 124 is level even on an unlevel floor, assuring that the intentional downward slope of described design components are most effective. Small threaded adjuster feet can be attached to the underside of the ball launcher 124 base to achieve level, which would in turn assure that the intentionally downward sloping surfaces were effective.

Prior to the rolling ball contacting any roller 148 wheel(s) it is necessary to activate the motor 140 to cause a roller 148 wheel(s) to be spinning at the appropriate ball-launch speed, before the ball arrives. The motor 140 activation means, integral to the effectiveness of the ball launcher 124, can be an electro-mechanical switch contacted by the ball, or preferably either a light beam or an infrared beam that intersects the pathway of the ball prior to its being in contact with a roller 148 wheel(s). Once the ball breaks a beam or touches a switch, circuitry is powered on and the roller 148 wheel(s) will be spinning at the desired rotation to launch the ball forward. Power to the motor 140 can be shut off by a timer circuit or by the ball passing by a second beam or a second electro-mechanical switch to turn off the power to the motor 140. An alternative to roller 148 wheels spinning to propel the ball forward down the track, an electro-magnetic solenoid plunger could be activated to shoot the ball out of the ball launcher 124 and down the track.

Attached to the exit end of the ball launcher 124 is a first track section 152, preferably durable plastic as earlier described. The plastic track can be extruded or injection molded. Alternative track material could be metal such as aluminum or even wood for a classical appearance in a home environment. Track attachment can be easily accomplished by simple plastic connectors 154 that slide into grooves in the underside of both components being attached. In this portion of the invention a plastic connector attaches the ball launcher 124 base plate to the first track section 152. Additional track sections 152 are assembled together generally in like manner, utilizing connectors 154.

Although the system may be designed to be readily customizable as to left or right-handed ball delivery, and transportable with easy assembly and disassembly, the plastic connectors 154 can be provided with holes for the user to screw-mount the plastic connectors 154 to the floor for most secure and functionally permanent positioning. The underside of the track sections 152 of the inventions include a flat surface so that the user can utilize double-sided foam tape to affix the track to a hard smooth floor.

Low voltage wiring between the ball launcher 124, transformer and control unit 142 are best directed and kept in alignment one with another by the wiring being located beneath the track sections 152 and maintained in place by extruded grooves or clips running underneath the track sections 152.

The control unit 142 is most effectively located nearby the ball holding tray 130 to allow the golfer 20 convenient physical access to power on and off and to operate all controls of the invention, by hand, or by touch with their golf club.

The track sections 152 are linear elements that can be extruded for cost efficiency. Track sections 152 can vary in length although preferably provided in one and two foot long sections, allowing users of the system the ability to determine a personally desired distance from the ball launcher 124 below the Simulator screen all the way to the ball holding tray 130 from which the golfer 20 can then move the ball onto the hitting mat.

In one embodiment, the fully assembled track section 152 portion will likely be between 8 and 12 feet from the Simulator screen, typical to golf simulator positioning for the golfer 20 to launch a ball towards the Screen.

Preferably the tray 130 will be at either side of the hitting mat (depending upon a left or right-handed golfer 20 assembly). However, an alternative configuration would be the track assembly 126 being routed down one sides of the teeing mat 128 and then additional track sections 152, including one ninety-degree curve section, added to position the ball holding tray 130 somewhere along the centerline of the teeing mat 128 for either-handed golfer 20*s* to access.

An injection molded curved track section 152 will connect to the furthest-position straight track section 152. Connectors 154 can be molded directly in the curved section. The rolling ball will then turn 90 degrees and travel towards the holding tray 130, and the golfer 20.

Preferably, at least one additional straight track section 152 is connected to the exit-side of the curved track section 152. The end of the final track section 152 will connect to a passive ball brake device that can be molded, by its shape, to slow the ball down by directing the ball to come into contact with a molded inner shape to deflect the ball and halt its forward momentum. The now-slowed-down ball will drop downward into a low-walled ball holding tray 130 from which the golfer 20 can easily access the ball either by hand or by his golf club. The delivery of the ball into a consistently positioned tray 130 provides the golfer 20 with the ability to maintain the general position of his feet for his next shot. An alternative braking method, would be a passive brush or curtain to contact the rolling ball and slow its forward momentum.

Mounted in close proximity to the ball holding tray 130 and ball brake is the control unit 142 that provides the golfer 20 with convenient and easily hand-or-golf-club accessible buttons to control the electronics of the invention—power on and off, and to control the speed of the motor 140 in the ball launcher 124. The control unit 142 contains a printed circuit board, an optional LCD display screen, a speaker (piezo or cone), and several buttons that can be activated to initiate manual cycling of the ball launcher 124 in the event of a ball getting jammed. An LCD screen can display error codes such as a ball entering but not exiting the launcher, a ball being at the launcher exit sensor without have been at the entrance sensor (having rolled backwards). The LCD screen, or individual LED lights can display the speed at which the launcher is set, power ON status, etc. LED lights can also be employed to conveniently illuminate the control unit 142 and ball holding tray 130, particularly desirable in the typical low-light environment in which Golf Simulator Systems are often utilized. The control unit 142 is preferably DC powered via wire and (as earlier described) under-track connection to the (earlier described) transformer. Alternatively, a transformer, or DC batteries could be onboard the control unit 142.

Users of Golf Simulator Systems typically utilize their smartphone or a tablet to display data relating to the golf simulation experience, and often to even control aspects of the simulation system projection, playback, course selection for display, performance stats, etc. Many such third party systems provide downloadable apps for these purposes. This is well known to anyone skilled in the art. A small shelf can be designed into the ball holding tray 130 or the control unit 142 to provide the golfer 20 with a convenient location to place a smartphone or tablet for those desired display and activation purposes.

An option for the invention would be to include its own image display screen that would wirelessly or by wire communicate with, and function in like manner as, the screen on a smartphone or tablet.

Considering advantages of some embodiments of the invention, in some embodiments the system may be installed on top of an existing floor or surface. That is, laborious cutting, drilling or excavation of existing floor surface may be avoided. However, in other embodiments, the system may be installed at least in part under the floor 1.

There may be a user-adjustable length of ball track, left or right-handed installation for track components to accommodate either-handed golfers. The system of the invention can also be modified for delivering the ball behind teeing mat 128 to present the golf ball midway (widthwise), at the rear of the teeing mat 128 for equal access by either-handed golfers. Similarly, the precise location of various components of the invention may be adjusted relative to those shown in the drawings.

Other features that may optionally be incorporated into embodiments of the invention include adjustable ball return speed and adjustable width of ball catcher assembly.

The invention described herein would work with any combination of launch monitor, golf simulator, or simple ball-catching net or screen.

What is claimed is:

1. A system for returning a golf ball to a golfer who is playing simulated golf, the system comprising:

a modular ball catcher tray assembly adapted to receive a golf ball after the golfer has hit the ball against an impact surface, the modular ball catcher tray comprising ball catcher tray sections connected together, a golf ball launcher adapted to receive the golf ball as it rolls from the modular ball catcher tray assembly;

a modular track system comprised of interconnected track sections, at least one of which is connected to the golf ball launcher and is adapted to receive the golf ball from the golf ball launcher as the ball is propelled toward the golfer;

a ball holding tray at one end of the modular track system, the ball holding tray being located adjacent to an area from which the golfer hits the ball; and a control panel adapted to permit the golfer to control an aspect of the system for returning the golf ball, wherein the ball catcher tray sections are comprised of foam material, each of the ball catcher tray sections has a trough into which a ball can roll, and the ball catcher tray sections include wedge shaped ramp sections secured within the respective troughs, such that the wedge shaped ramp sections in sequence form a downwardly-sloping path for a ball to roll down, and wherein the ball catcher tray sections are secured together with connector pins on the underside of the ball catcher tray sections, and each of the ball catcher tray sections has an angled top surface to direct a ball to roll toward a respective trough, and wherein the track sections comprise straight track sections and curved track sections, and wherein the system includes a plurality of shingles at a top edge of the ball catcher tray assembly, and wherein the shingles are movable, and wherein the ball launcher is at an end of the ball catcher tray assembly, with ball catcher tray assembly sloping downwardly toward the ball launcher at the end of the ball catcher tray assembly, and with the ball catcher tray assembly having a top surface configured to cause ball to roll toward the ball launcher, and wherein the control panel is located adjacent to a location where the golfer golfs, and wherein a smartphone or tablet computer controls at least one function of the system, and wherein the track sections connect in a desired sequence with track connectors, and wherein the impact surface is an impact-absorbing screen.

2. The system of claim 1 wherein the system is adapted to gather and analyze golfer performance data.

3. The system of claim 1 further comprising a stand for holding a smartphone or tablet.

4. The system of claim 1 wherein the track sections comprise space underneath to accommodate wiring.

5. A golf ball return system for returning a golf ball to a golfer, the system having:

a connector that movably couples the golf ball return system to an impact absorbing surface, said surface adapted to receive golf balls that the golfer hits;

a ball catcher tray comprised of down-angled foam sections to direct a golf ball to roll towards a motorized ball launcher assembly;

the motorized ball launcher assembly containing a down-angled pathway and a ball sensor to detect the presence of the golf ball and activate a motorized ball driver to propel the ball;

a track coupled to an exit end of the motorized ball launcher to receive the golf ball and to direct the ball towards the golfer;

a speed brake to slow momentum of the ball;

a holding tray adjacent to the golfer and into which the golf ball is deposited to the golfer; and a golfer-controlled speed control allowing the golfer to adjust motor speed to control speed of ball return, wherein the ball return system further comprises at least one movable shingle coupled to the impact absorbing surface;

wherein the motorized golf ball launcher assembly is configured to adjust the launch speed of the golf ball based on input from the motor speed control, allowing the golfer to customize the return speed of the golf ball to accommodate personal preferences.

6. The system of claim 5, further comprising a data collection module associated with the system, configured to gather performance data related to at least one of golf ball trajectory, speed, spin, and launch angle.

7. The system of claim 6, further comprising an artificial intelligence analysis unit configured to process the performance data and provide feedback and recommendations to the golfer for improving performance.

8. The system of claim 5 wherein ball catcher tray sections are secured together with connector pins on the underside of the ball catcher tray sections.

9. A motorized system for returning a golf ball to a golfer who is playing simulated golf, the system comprising:

a ball catcher tray assembly adapted to receive a golf ball after the golfer has hit the ball against an impact surface;

a motorized golf ball launcher adapted to receive the golf ball as it rolls from the ball catcher tray assembly and to launch the golf ball for travel back to the golfer;

a conduit system comprised of interconnected conduit sections, the conduit sections comprising track and/or tube sections, in which at least one of the conduit sections is connected to the motorized golf ball launcher and is adapted to receive the golf ball from the motorized golf ball launcher as the ball is propelled toward the golfer;

a conduit exit located adjacent to the golfer, from which the golf ball exits the system for returning a golf ball to a golfer; and a motor speed control with which the golfer can control motor speed of the motorized golf ball launcher;

wherein the motorized golf ball launcher is configured to adjust the launch speed of the golf ball based on input from the motor speed control, allowing the golfer to customize the return speed of the golf ball to accommodate personal preferences.

10. The system of claim 9, further comprising a golf ball brake adjacent to the conduit exit, adapted to slow speed of the ball as it approaches the golfer.

11. The system of claim 9, wherein the ball tray assembly is modular and comprises multiple foam tray section blocks joined together.

12. The system of claim 11, wherein each of the foam tray section blocks has a trough into which a ball can roll.

13. The system of claim 11 wherein the foam tray section blocks include a trough, and a wedge-shaped ramp section secured within the respective trough, such that a sequence of ball wedge shaped ramp sections in the connected ball catcher tray section blocks form a downwardly-sloping path for a ball to roll down.

14. The system of claim 11 wherein the foam tray section blocks the ball catcher tray sections are secured together with connector pins on the underside of the foam tray section blocks ball catcher tray sections.

15. The system of claim 11 wherein the foam tray section blocks the ball catcher tray sections each have an angled top surface to direct a ball to roll toward a respective trough.

16. The system of claim 9, further comprising a ball holding tray at the golf ball conduit exit.

17. The system of claim 9, further comprising a data collection module asssociated with the system, configured to gather performance data related to at least one of golf ball trajectory, speed, spin, and launch angle.

18. The system of claim 17, further comprising an artificial intelligence analysis unit configured to process the performance data and provide feedback and recommendations to the golfer for improving performance.

19. The system of claim 9, further comprising a sensor system integrated with the ball launcher, the sensor system configured to detect the presence of the golf ball and automatically activate the launcher, thereby reducing the need for manual intervention by the golfer.

20. The system of claim 9, wherein the conduit system includes adjustable sections that can be reconfigured to alter path and length of the conduit, providing flexibility in setup to accommodate different playing environments and golfer preferences.

* * * * *